US008878770B2

(12) United States Patent
Miyazaki et al.

(10) Patent No.: US 8,878,770 B2
(45) Date of Patent: Nov. 4, 2014

(54) CONTROL METHOD OF ELECTRO-OPTICAL DEVICE, CONTROLLER OF ELECTRO-OPTICAL DEVICE, ELECTRO-OPTICAL DEVICE, AND ELECTRONIC APPARATUS

(75) Inventors: Atsushi Miyazaki, Suwa (JP); Kota Muto, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 220 days.

(21) Appl. No.: 13/461,239

(22) Filed: May 1, 2012

(65) Prior Publication Data

US 2012/0287174 A1 Nov. 15, 2012

Related U.S. Application Data

(60) Provisional application No. 61/484,372, filed on May 10, 2011.

(30) Foreign Application Priority Data

Sep. 29, 2011 (JP) ..... 2011-214383

(51) Int. Cl.
*G09G 3/34* (2006.01)

(52) U.S. Cl.
CPC ..... *G09G 3/344* (2013.01); *G09G 2300/08* (2013.01); *G09G 2320/103* (2013.01); *G09G 2310/04* (2013.01)
USPC ..... 345/107

(58) Field of Classification Search
USPC ..... 345/107
See application file for complete search history.

(56) References Cited

U.S. PATENT DOCUMENTS

| | | | | |
|---|---|---|---|---|
| 2002/0021483 | A1 | 2/2002 | Katase | |
| 2010/0001946 | A1 * | 1/2010 | Murayama et al. | 345/107 |
| 2010/0073282 | A1 * | 3/2010 | Murayama | 345/107 |
| 2010/0118046 | A1 | 5/2010 | Miyasaka et al. | |
| 2012/0044276 | A1 | 2/2012 | Yamada | |

FOREIGN PATENT DOCUMENTS

| | | |
|---|---|---|
| JP | B2-3750565 | 3/2006 |
| JP | A-2010-113281 | 5/2010 |
| JP | A-2012-42685 | 3/2012 |

* cited by examiner

*Primary Examiner* — Kevin M Nguyen
*Assistant Examiner* — Cory Almeida
(74) *Attorney, Agent, or Firm* — Oliff PLC

(57) ABSTRACT

A control method of an electro-optical device includes: performing a first supply process for supplying an electric potential corresponding to the changed gray level to a pixel electrode of a first pixel; performing a second supply process for supplying the same electric potential as an electric potential of a counter electrode to a pixel electrode of a second pixel; extracting a contour image from a difference between an image before the image rewriting and an image after the image rewriting; determining whether or not the first supply process is being performed, in units of a pixel, for contour display pixels that display the contour image; and performing a contour elimination process for supplying an electric potential for eliminating the contour image to the pixel electrode of a pixel, for which it is determined that the first supply process is not being performed, among the contour display pixels.

14 Claims, 27 Drawing Sheets

| REGION | ELECTRIC POTENTIAL | NUMBER OF FRAMES |
|---|---|---|
| Rww (WHITE→WHITE) | 0V | 0 |
| Rbb (BLACK→BLACK) | 0V | 0 |
| Rwb (WHITE→BLACK) | +15V | 7 |
| Rbw (BLACK→WHITE) | -15V | 7 |

| REGION | ELECTRIC POTENTIAL | NUMBER OF FRAMES |
|---|---|---|
| Rsw (CONTOUR→WHITE) | -15V | 1 |
| Rsb (CONTOUR→BLACK) | +15V | 1 |

CONTROL METHOD OF ELECTRO-OPTICAL DEVICE, CONTROLLER OF ELECTRO-OPTICAL DEVICE, ELECTRO-OPTICAL DEVICE, AND ELECTRONIC APPARATUS

BACKGROUND

1. Technical Field

The present invention relates to a control method of an electro-optical device, such as an electrophoretic display device, a controller of an electro-optical device, an electro-optical device, and an electronic apparatus.

2. Related Art

Examples of an electro-optical device include an electrophoretic display device which displays an image on its display unit by applying a voltage between a pixel electrode and a counter electrode, which face each other with an electrophoretic element including electrophoretic particles interposed therebetween, in order to move electrophoretic particles, such as black particles and white particles, (for example, refer to Japanese Patent Publication No. 3750565 and JP-A-2010-113281). The electrophoretic element is formed by a plurality of microcapsules including a plurality of electrophoretic particles, for example, and is fixed between a pixel electrode and a counter electrode by an adhesive, such as a resin. In addition, the counter electrode is also called a common electrode.

When rewriting an image displayed on the display unit in such an electrophoretic display device, a driving method for rewriting an image partially by applying a voltage between the pixel electrode of only a pixel, which corresponds to a changed portion, and the counter electrode (hereinafter, appropriately referred to as "partial rewriting driving") may be adopted if an image changes partially. In the electrophoretic display device in which such partial rewriting driving is adopted, for example, there is a possibility that the boundary of a black image portion displayed in black and a white image portion displayed in white in an image displayed on the display unit will be displayed in a blurred state. In other words, it is known that a contour portion of the black image portion may be displayed in a state spreading to the white image portion side (or in a bulging state) (for example, refer to JP-A-2010-113281).

When such a blurring of the boundary occurs, the blur of the boundary may remain as an afterimage if the entire image displayed on the display unit is rewritten to a white image by applying a voltage to only a pixel corresponding to the black image portion. In other words, an afterimage along the contour portion of the displayed black image portion may be generated. Hereinafter, such a phenomenon in which an afterimage along the contour portion is generated or such an afterimage itself along the contour portion is appropriately referred to as a "contour afterimage". For example, JP-A-2010-113281 discloses a technique of eliminating a contour afterimage by applying a voltage so that a portion remaining as a contour afterimage (for example, a pixel which is disposed adjacent to a pixel corresponding to a contour portion of a black image portion and which is displayed in white) is also rewritten when rewriting an image displayed on a display unit by the partial rewriting driving.

In the technique disclosed in JP-A-2010-113281, however, processing for eliminating the contour afterimage is performed every image rewriting. For this reason, a period taken for the image rewriting becomes long. As a result, for example, display switching between a plurality of pages cannot be smoothly performed. This may degrade the usability significantly. That is, the technique disclosed in JP-A-2010-113281 has a technical problem in that new inconvenience is caused even if the contour afterimage generated at the time of image rewriting can be eliminated.

SUMMARY

An advantage of some aspects of the invention is to provide a control method of an electro-optical device capable of displaying a high-quality image by appropriately suppressing the occurrence of a contour afterimage in an image displayed on a display unit, a controller of an electro-optical device, an electro-optical device, and an electronic apparatus.

An aspect of the invention is directed to a control method of an electro-optical device including a display unit having a plurality of pixels, which are provided corresponding to intersections of a plurality of scanning lines and a plurality of data lines crossing each other and each of which has an electro-optical material interposed between a pixel electrode and a counter electrode facing each other, and a driving unit that performs electric potential supply, which is for supplying a data potential according to image data to the pixel electrode of each of the plurality of pixels in a predetermined frame period, multiple times in order to display an image corresponding to the image data on the display unit. The control method of an electro-optical device includes: performing a first supply process for supplying an electric potential corresponding to a changed gray level to the pixel electrode of a first pixel whose gray level to be displayed changes at the time of image rewriting in which an image displayed on the display unit is rewritten; performing a second supply process for supplying the same electric potential as an electric potential of the counter electrode to the pixel electrode of a second pixel whose gray level to be displayed does not change at the time of the image rewriting; extracting a contour image from a difference between an image before the image rewriting and an image after the image rewriting; determining whether or not the first supply process is being performed, in units of a pixel, for contour display pixels that display the contour image; and performing a contour elimination process for supplying an electric potential for eliminating the contour image to the pixel electrode of a pixel, for which it is determined that the first supply process is not being performed, among the contour display pixels.

An electro-optical device controlled by the control method of an electro-optical device according to the aspect of the invention is an active matrix driving type electrophoretic display device, for example. The electro-optical device includes a display unit having a plurality of pixels, which are arrayed in a matrix, for example, corresponding to intersections of a plurality of scanning lines and a plurality of data lines, and a driving unit that supplies the data potential according to image data to the pixel electrode of each pixel.

In the electro-optical device, the driving unit supplies the data potential according to the image data multiple times to the pixel electrode in each of the plurality of pixels, and an image corresponding to the image data is displayed on the display unit. The electric potential supply of the driving unit is performed in units of a predetermined frame period, for example. Specifically, during a predetermined frame period, a plurality of scanning lines are selected one by one in a predetermined order, and the data potential is supplied to pixel electrodes in pixels corresponding to the selected scanning line through the plurality of data lines. Here, the "frame period" is a period for which a plurality of scanning lines are selected one by one in a predetermined order, and is also a period set in advance. That is, the driving unit performs electric potential supply, which is for supplying the data potential to the pixel electrode in each of the plurality of pixels, once in each of the plurality of continuous frame periods and as a result, an image corresponding to the image data is displayed on the display unit.

In the control method of an electro-optical device according to the aspect of the invention, the first and second supply processes are performed as the above-described electric potential supply performed multiple times, at the time of image rewriting which is for rewriting an image (for example, an image with two gray levels of black and white) displayed on the display unit. In addition, the first and second supply processes are performed in parallel.

In the first supply process, an electric potential corresponding to the changed gray level (for example, a high electric potential which is higher than the electric potential of the counter electrode or a low electric potential which is lower than the electric potential of the counter electrode) is supplied to the pixel electrode of the first pixel whose gray level to be displayed changes (for example, changes from black to white or from white to black). By performing such electric potential supply multiple times, the gray level of the first pixel changes to become gradually close to gray level to be displayed.

In the second supply process, the same electric potential (for example, 0 V) as the electric potential of the counter electrode is supplied to the pixel electrode of the second pixel whose gray level to be displayed does not change (for example, black or white is maintained as it is). For this reason, in the second pixel, displayed gray level is maintained as it is, unlike the first pixel described above. Here, the "same electric potential as the electric potential of the counter electrode" refers to not only a completely equal electric potential but also a slightly different electric potential. For example, also when the electric potential of the counter electrode is set to a different value from the electric potential supplied to the pixel electrode of the second pixel in consideration of a change in the electric potential of the pixel electrode caused by a feed-through, the electric potential supplied to the pixel electrode of the second pixel and the electric potential of the counter electrode are assumed to be the same.

Moreover, in the invention, a contour image is extracted from the difference between the image before image rewriting and the image after image rewriting in the extraction process. The extraction process may be performed every image rewriting or may be performed whenever image rewriting is performed a predetermined number of times, for example. In addition, the "contour image" is an image corresponding to a contour afterimage generated by partial image rewriting as in the first or second supply process described above. A specific example of the principle of the occurrence of a contour afterimage will be described below.

For example, a case is considered in which only one pixel is rewritten to black from the state where two pixels adjacent to each other display white and then both the pixels are rewritten again to the state displaying white. In this case, when one pixel is rewritten to black, blurring due to the leak or the like described above occurs in the adjacent pixel which should hold white (that is, the vicinity of the boundary of the pixel which should hold white changes to gray partially). This blurring is hard to be visible relatively while one pixel displays black. However, ever after the one pixel displaying black is rewritten again to white, the blur generated in the pixel which has held white remains as it is. As a result, a contour afterimage which surrounds the pixel rewritten from black to white is generated.

After a contour image corresponding to the contour afterimage is extracted, it is determined in the determination processing whether or not the first supply process is being performed, in units of a pixel, for a contour display pixel which displays a contour image (that is, a pixel in which the gray level that should not be displayed is displayed as a contour afterimage). That is, it is determined in units of a pixel whether or not electric potential supply for changing the display gray level is being performed for each contour display pixel. Such determination can be realized by providing a memory or the like which can store a voltage supply state in units of a pixel, for example.

In particular, in the control method of an electro-optical device described above, the electric potential for eliminating the contour image is supplied to the pixel electrode of a pixel for which it is determined that the first supply process is not being performed, among the contour display pixels, in the contour elimination process. Specifically, when a gray contour afterimage is displayed in a pixel which should display white, for example, the electric potential for displaying white is supplied. Alternatively, when a gray contour afterimage is displayed in a pixel which should display black, the electric potential for displaying black is supplied. As a result, since the gray level of the contour display pixel changes to the gray level which should be originally displayed, it is possible to eliminate or reduce the contour afterimage. In addition, the electric potential supply in the contour elimination process is typically performed only once. However, it may be performed multiple times like the first and second supply processes.

As described above, in the control method of an electro-optical device according to the aspect of the invention, the image rewriting state of the contour display pixel can be determined in units of a pixel in the determination process. Therefore, contour images can be eliminated sequentially from a pixel on which image rewriting is not performed (that is, a pixel to which the electric potential for changing the gray level is not supplied). In this case, since the display unit is driven on the whole as if the image rewriting operation and the contour elimination operation were going on simultaneously in each pixel, it is possible to realize a state where it is very difficult to see a contour afterimage. As a result, it becomes possible to display a high-quality image.

In one aspect of the control method of an electro-optical device, in the contour elimination process, an electric potential for eliminating the contour image is supplied to the pixel electrode of a pixel for which it is determined that the first supply process is not being performed, among the contour display pixels, in a last frame period of the first supply process performed for pixels adjacent to each other.

In this aspect of the invention, a contour afterimage of the contour display pixel is eliminated according to the last frame period of the first supply process performed for a pixel adjacent to the contour display pixel (that is, the last frame period of a plurality of frame periods necessary for image rewriting). Since the contour afterimage is eliminated simultaneously with the end of image rewriting if the contour afterimage is eliminated at such timing, it is possible to make the contour afterimage even less visible.

The electric potential supply in the contour elimination process may be performed only in the last frame period of the first supply process performed for a pixel adjacent to the contour display pixel or may be performed including other frame periods.

In one aspect of the control method of an electro-optical device, in the contour elimination process, an electric potential for eliminating the contour image is supplied to the pixel electrode of a pixel for which it is determined that the first supply process is being performed, among the contour display pixels, in a frame period after the first supply process ends.

In this aspect of the invention, the electric potential for eliminating a contour image is supplied to the pixel electrode of a pixel, for which it is determined that the first supply process is being performed in the determination processing, in a frame period after the first supply process ends. For this reason, in a phase in which it is determined that a contour afterimage is displayed, the contour afterimage can be reliably eliminated as soon as rewriting of an image is completed even if the pixel is a contour display pixel on which image rewriting is performed.

In one aspect of the control method of an electro-optical device, the contour elimination process is performed once for the image rewriting performed multiple times.

In this aspect of the invention, the contour elimination process is performed whenever image rewriting is performed multiple times instead of being performed every image rewriting. Therefore, contour afterimages generated in image rewriting performed multiple times are eliminated collectively. In addition, the number of times of image rewriting required for performing the contour elimination process is set in advance on the basis of the contour afterimage elimination effect and the like. In addition, this number of times may be variable.

When eliminating contour afterimages collectively, the contour afterimages are extracted, as contour images generated by image rewriting performed multiple times, in the extraction process. For example, if the OR operation of contour images generated in image rewriting performed multiple times is performed, the contour images generated in the image rewriting performed multiple times can be easily extracted.

If contour afterimages are collectively eliminated, the number of times by which the contour elimination process is performed is reduced. In proportion to the reduced value, image display can be realized at higher speed. Therefore, it is possible to realize high-speed image display and an improvement in the display quality simultaneously.

In one aspect of the control method of an electro-optical device, a period for which the electric potential for eliminating the contour image is supplied in the contour elimination process is shorter than a period for which the electric potential corresponding to the changed gray level is supplied in the first supply process.

In this aspect of the invention, since the period for which the electric potential for eliminating the contour image is supplied in the contour elimination process can be made relatively short, the process can be simplified. In addition, it is possible to suppress or prevent inconsistency in the DC balance ratio (that is, a ratio of the period for which a voltage corresponding to one gray level is applied between the pixel electrode and the counter electrode and the period for which a voltage corresponding to another gray level is applied between the pixel electrode and the counter electrode).

Another aspect of the invention is directed to a controller of an electro-optical device including a display unit having a plurality of pixels, which are provided corresponding to intersections of a plurality of scanning lines and a plurality of data lines crossing each other and each of which has an electro-optical material interposed between a pixel electrode and a counter electrode facing each other, and a driving unit that performs electric potential supply, which is for supplying a data potential according to image data to the pixel electrode of each of the plurality of pixels in a predetermined frame period, multiple times in order to display an image corresponding to the image data on the display unit, The controller of an electro-optical device includes: a first supply section that supplies an electric potential corresponding to a changed gray level to the pixel electrode of a first pixel whose gray level to be displayed changes at the time of image rewriting in which an image displayed on the display unit is rewritten; a second supply section that supplies the same electric potential as an electric potential of the counter electrode to the pixel electrode of a second pixel whose gray level to be displayed does not change at the time of the image rewriting; an extraction section that extracts a contour image from a difference between an image before the image rewriting and an image after the image rewriting; a determination section that determines whether or not the electric potential supply of the first supply section is being performed, in units of a pixel, for contour display pixels that display the contour image; and a contour elimination section that supplies an electric potential for eliminating the contour image to the pixel electrode of a pixel, for which it is determined that the electric potential supply of the first supply section is not being performed, among the contour display pixels.

In the controller of an electro-optical device according to the aspect of the invention, a contour afterimage caused by rewriting of an image can be reduced in an electro-optical device, in the same manner as in the above control method of an electro-optical device. As a result, it becomes possible to display a high-quality image.

Also in the controller of an electro-optical device according to the aspect of the invention, the same various aspects as described in the above control method of an electro-optical device may also be applied.

In one aspect of the controller of an electro-optical device, the controller further includes: a number-of-times storage section that stores the number of times by which the electric potential supply of the first supply section for each of the plurality of pixels is performed; and a decrement section that decrements the number of times by which the electric potential supply is performed, which is stored in the number-of-times storage section, whenever the electric potential supply is performed.

In this aspect of the invention, the number of times by which the electric potential supply (that is, electric potential supply for changing display gray level) of the first supply section for each of the plurality of pixels is to be performed is stored in the number-of-times storage section, such as a RAM (Random Access Memory), for example. Specifically, for example, when pixels (i rows×j columns) are arrayed on the display unit, the number of times by which the electric potential supply to each pixel is to be performed is stored in "i×j" storage regions of the number-of-times storage section.

The number of times for which electric potential supply is to be performed, which is stored in the number-of-times storage section, is decremented by the decrement section whenever the electric potential supply is performed. Accordingly, the electric potential supply of the first supply section is performed until the number of times stored in the number-of-times storage section becomes "0".

According to the configuration described above, it is possible not only to appropriately perform the electric potential supply of the first supply section for each pixel but also to appropriately determine by the determination section whether or not the electric potential supply of the first supply section is being performed. As a result, it becomes possible to eliminate a contour image at appropriate timing.

In one aspect of the controller of an electro-optical device, the controller further includes a plurality of flag storage sections that store flag information, which indicates whether to perform the electric potential supply of the first supply section for each of the plurality of pixels, in units of a frame period.

In this aspect of the invention, the flag information indicating whether to perform the electric potential supply of the first supply section for each of the plurality of pixels is stored in a plurality of flag storage sections, such as RAMs, for example. Specifically, for example, when pixels (i rows×j columns) are arrayed on the display unit, the flag storage sections are configured to have "i×j" storage regions. In addition, in the flag storage section corresponding to the first frame period among the plurality of flag storage sections, "1" is stored in a storage region corresponding to a pixel for which electric potential supply is to be performed in the first frame period, and "0" is stored in a storage region corresponding to a pixel for which electric potential supply is not performed in the first frame period. Similarly, in the flag storage section corresponding to the second frame period (that is, a frame period subsequent to the first frame period) among the plurality of flag storage sections, "1" is stored in a storage region corresponding to a pixel for which electric potential supply is to be performed in the second frame period, and "0" is stored in a storage region corresponding to a pixel for which electric potential supply is not performed in the second frame period. The first supply section performs electric potential supply in each frame period according to such flag information.

According to the configuration described above, it is possible not only to appropriately perform the electric potential supply for each pixel but also to appropriately determine by the determination section whether or not the electric potential supply of the first supply section is being performed. As a result, it becomes possible to eliminate a contour image at appropriate timing.

Still another aspect of the invention is directed to an electro-optical device including the controller of an electro-optical device described above (various aspects are also included).

In the electro-optical device according to the aspect of the invention, a contour afterimage caused by rewriting of an image can be reduced since the controller of an electro-optical device according to the above aspect of the invention is included. As a result, it becomes possible to display a high-quality image.

Yet another aspect of the invention is directed to an electronic apparatus including an electro-optical device described above (various aspects are also included).

Since the electronic apparatus according to the aspect of the invention includes the electro-optical device according to the above aspect of the invention, it is possible to realize various kinds of electronic apparatuses capable of displaying a high-quality image, such as wrist watches, electronic paper, electronic books, mobile phones, and portable audio equipment, for example.

The operations and other advantages of the invention will be apparent from embodiments of the invention described below.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings.

Electro-Optical Device

First, an electro-optical device according to the present embodiment will be described with reference to FIGS. 1 to 35. Moreover, in the following embodiment, an electrophoretic display device will be described as an example of the electro-optical device according to the present embodiment of the invention.

First Embodiment

The overall configuration of an electrophoretic display device according to a first embodiment will be described with reference to FIGS. 1 to 3.

Figure 1:
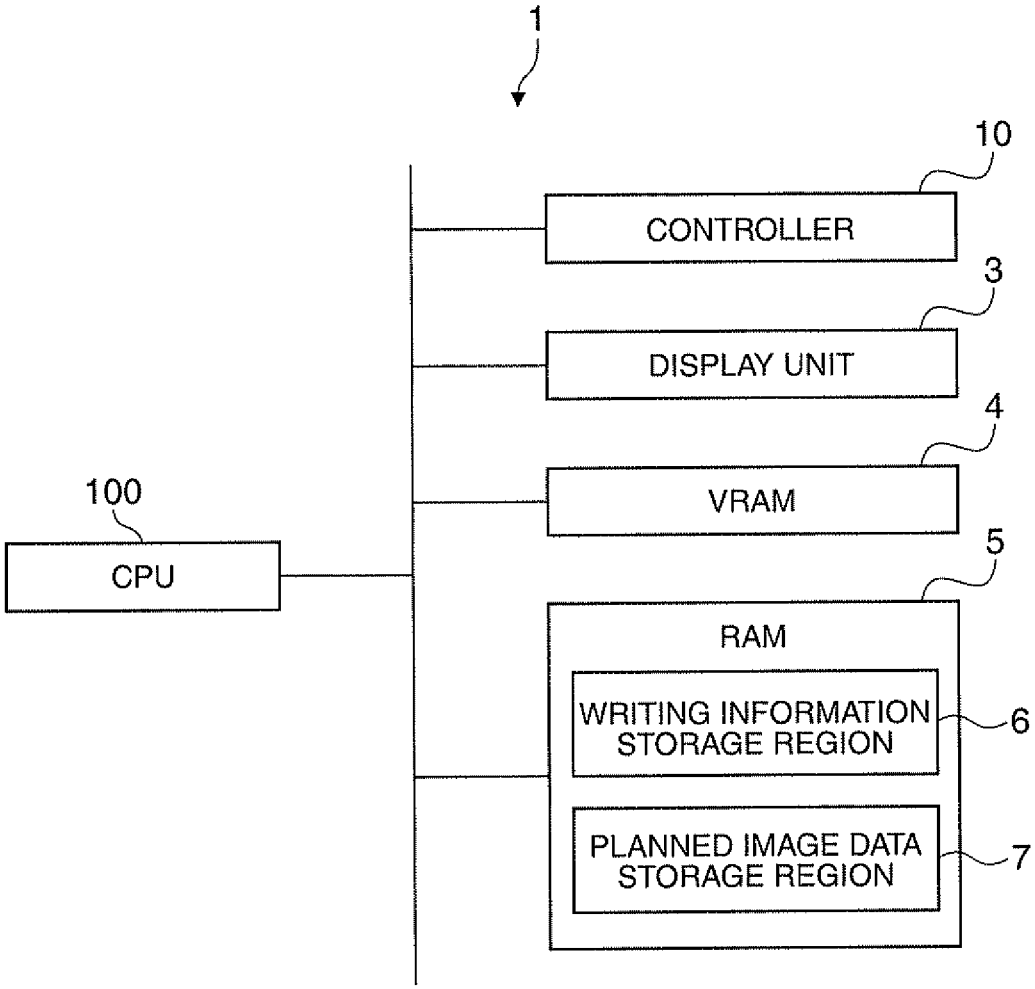
FIG. 1 is a block diagram showing the overall configuration of an electrophoretic display device according to a first embodiment.

FIG. 1 is a block diagram showing the overall configuration of the electrophoretic display device according to the first embodiment.

Referring to FIG. 1, the electrophoretic display device 1 according to the present embodiment is configured to include a display unit 3, VRAM 4, RAM 5, a controller 10, and a CPU 100.

The display unit 3 is a display device which has a display element with a memory ability and accordingly maintains its display state even in a state where writing is not performed. The specific configuration of the display unit will be described in detail later.

The VRAM 4 is a frame buffer, and stores frame image data under the control of the CPU 100.

The RAM 5 includes a writing information storage region 6 and a planned image data storage region 7. Writing information indicating whether or not writing is performed for each pixel is stored in the writing information storage region 6. Data of a planned image displayed when the writing performed currently for each pixel is completed is stored in the planned image data storage region 7.

The controller 10 controls the display unit by outputting an image signal indicating an image displayed on the display unit 3 and other various signals (for example, a clock signal).

The CPU 100 is a processor which controls an operation of the electrophoretic display device 1 and in particular, stores the image data displayed on the display unit 3 in the VRAM 4.

Figure 2:
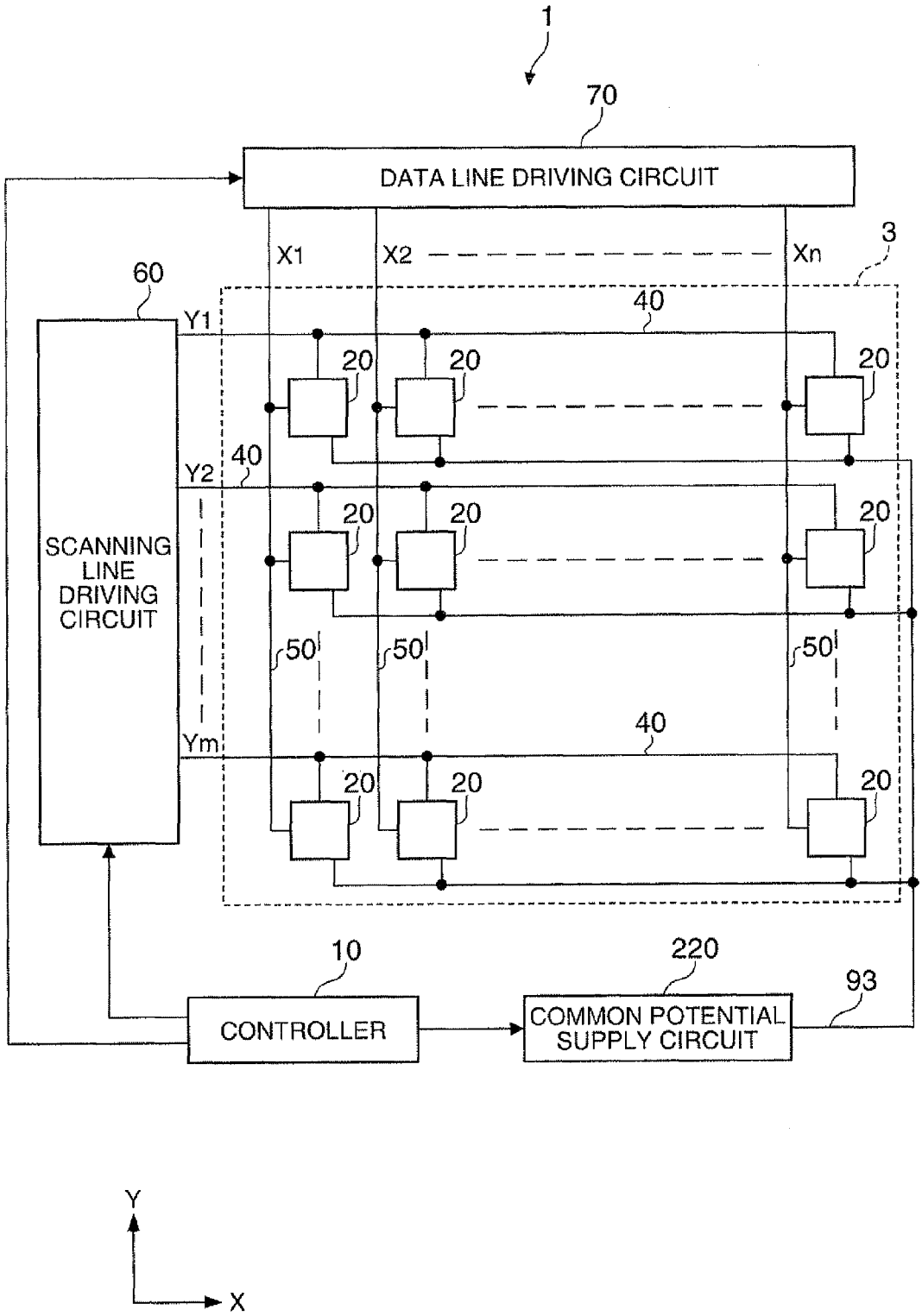
FIG. 2 is a block diagram showing the configuration around a display unit of the electrophoretic display device according to the first embodiment.

FIG. 2 is a block diagram showing the configuration around the display unit of the electrophoretic display device according to the first embodiment.

Referring to FIG. 2, the electrophoretic display device 1 according to the present embodiment is an active matrix driving type electrophoretic display device, and includes the display unit 3, the controller 10, a scanning line driving circuit 60, a data line driving circuit 70, and a common potential supply circuit 220.

In the display unit 3, pixels 20 of "m" rows×"n" columns are arrayed in a matrix (in a two-dimensional plane). In addition, "m" scanning lines 40 (that is, scanning lines Y1, Y2, . . . , Ym) and "n" data lines 50 (that is, data lines X1, X2, . . . , Xn) are provided in the display unit 3 so as to cross each other. Specifically, the "m" scanning lines 40 extend in a row direction (that is, an X direction), and the "n" data lines 50 extend in a column direction (that is, a Y direction). The pixels 20 are disposed corresponding to intersections between the "m" scanning lines 40 and the "n" data lines 50.

The controller 10 controls the operations of the scanning line driving circuit 60, the data line driving circuit 70, and the common potential supply circuit 220. For example, the controller 10 supplies timing signals, such as a clock signal and a start pulse, to each circuit.

The scanning line driving circuit 60 supplies a scanning signal to each of the scanning lines Y1, Y2, . . . , Ym sequentially in a pulsed manner during a predetermined frame period under the control of the controller 10.

The data line driving circuit 70 supplies a data potential to each of the data lines X1, X2, . . . , Xn under the control of the controller 10. The data potential is a reference potential GND (for example, 0 V), a high potential VH (for example, +15 V), or a low potential VL (for example, −15 V). In addition, as will be described later, the above-described partial rewriting driving is adopted in the present embodiment.

The common potential supply circuit 220 supplies a common potential Vcom (in the present embodiment, the same electric potential as the reference potential GND) to a common potential line 93. In addition, the common potential Vcom may be an electric potential different from the reference potential GND in the range where a voltage is not generated substantially between a counter electrode 22 to which the common potential Vcom is supplied and a pixel electrode 21 to which the reference potential GND is supplied. For example, the common potential Vcom may be set as a different value from the reference potential GND supplied to the pixel electrode 21 in consideration of a change in the electric potential of the pixel electrode 21 caused by a feed-through. Also in this case, the common potential Vcom and the reference potential GND are assumed to be the same in this specification. Here, the feed-through means a phenomenon in which when the supply of a scanning signal to the scanning line 40 ends (for example, when the electric potential of the scanning line 40 drops) after the scanning signal is supplied to the scanning line 40 and an electric potential is supplied to the pixel electrode 21 through the data line 50, the electric potential of the pixel electrode 21 changes due to the parasitic capacitance between the pixel electrode 21 and the scanning line 40 (for example, the electric potential of the pixel electrode 21 drops with a potential drop of the scanning line 40). The common potential Vcom may be set to a value slightly lower than the reference potential GND supplied to the pixel electrode 21 on the assumption that the electric potential of the pixel electrode 21 drops due to the feed-through. Also in this case, the common potential Vcom and the reference potential GND are assumed to be the same electric potential.

In addition, although various kinds of signals are input and output to and from the controller 10, the scanning line driving circuit 60, the data line driving circuit 70, and the common potential supply circuit 220, those which are not particularly related with the present embodiment will not be described.

Figure 3:
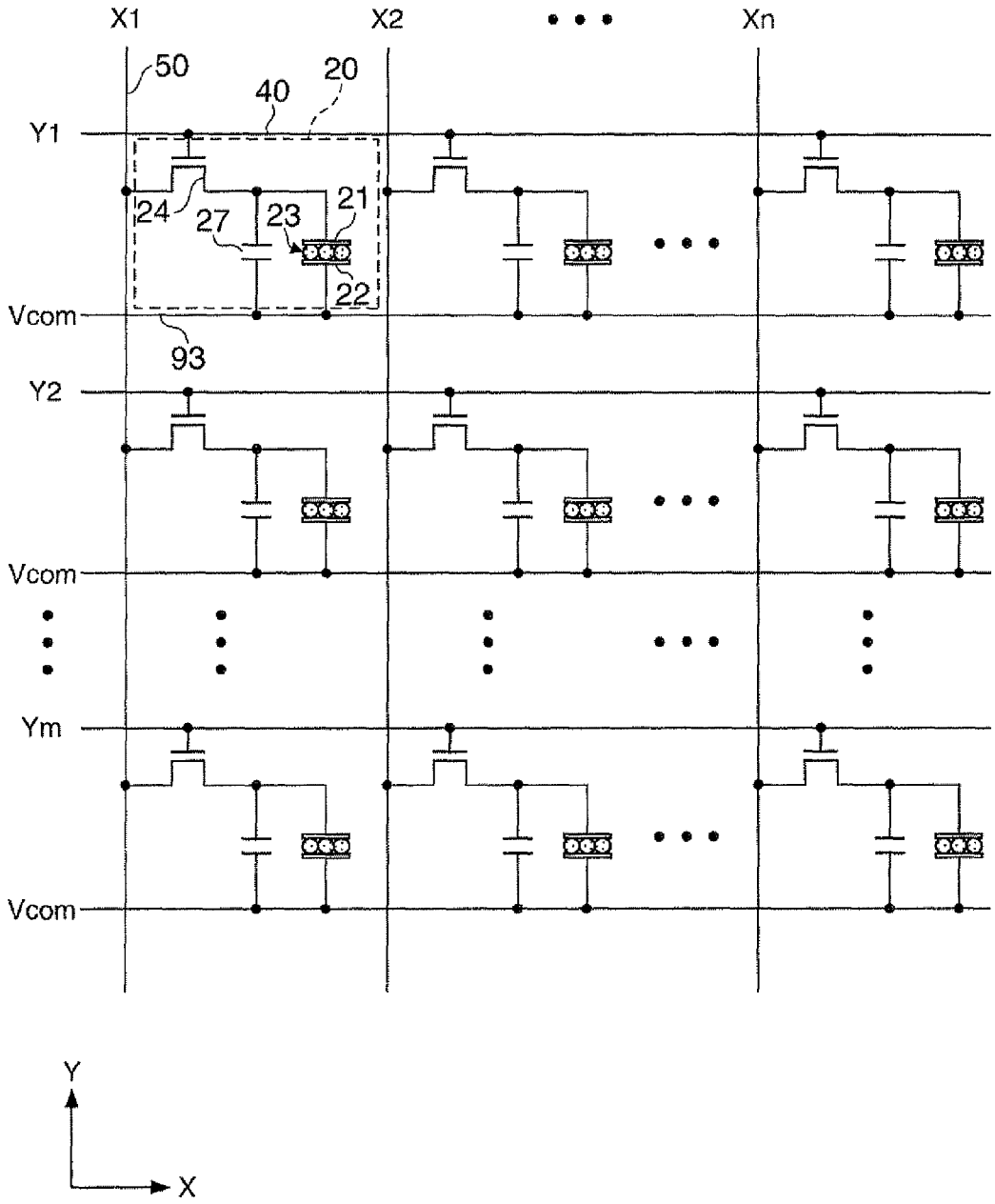
FIG. 3 is an equivalent circuit diagram showing the electric configuration of a pixel in the first embodiment.

FIG. 3 is an equivalent circuit diagram showing the electric configuration of the pixel 20 in the first embodiment.

Referring to FIG. 3, the pixel 20 includes a pixel switching transistor 24, the pixel electrode 21, the counter electrode 22, an electrophoretic element 23, and a holding capacitor 27.

The pixel switching transistor 24 is an N type transistor, for example. The pixel switching transistor 24 has a gate electrically connected to the scanning line 40, a source electrically connected to the data line 50, and a drain electrically connected to the pixel electrode 21 and the holding capacitor 27. The pixel switching transistor 24 outputs the data potential, which is supplied from the data line driving circuit 70 (refer to FIG. 2) through the data line 50, to the pixel electrode 21 and the holding capacitor 27 at a timing according to the scanning signal supplied in a pulsed manner from the scanning line driving circuit 60 (refer to FIG. 2) through the scanning line 40.

A data potential is supplied from the data line driving circuit 70 to the pixel electrode 21 through the data line 50 and the pixel switching transistor 24. The pixel electrode 21 is disposed so as to face the counter electrode with the electrophoretic element 23 interposed therebetween.

The counter electrode 22 is electrically connected to the common potential line 93 to which the common potential Vcom is supplied.

The electrophoretic element 23 is formed by a plurality of microcapsules including electrophoretic particles.

The holding capacitor 27 has a pair of electrodes disposed so as to face each other with a dielectric film interposed therebetween. One of the pair of electrodes is electrically connected to the pixel electrode 21 and the pixel switching transistor 24, and the other electrode is electrically connected to the common potential line 93. The data potential can be maintained during a fixed period by the holding capacitor 27.

Next, the specific configuration of the display unit of the electrophoretic display device according to the present embodiment will be described with reference to FIG. 4.

Figure 4:
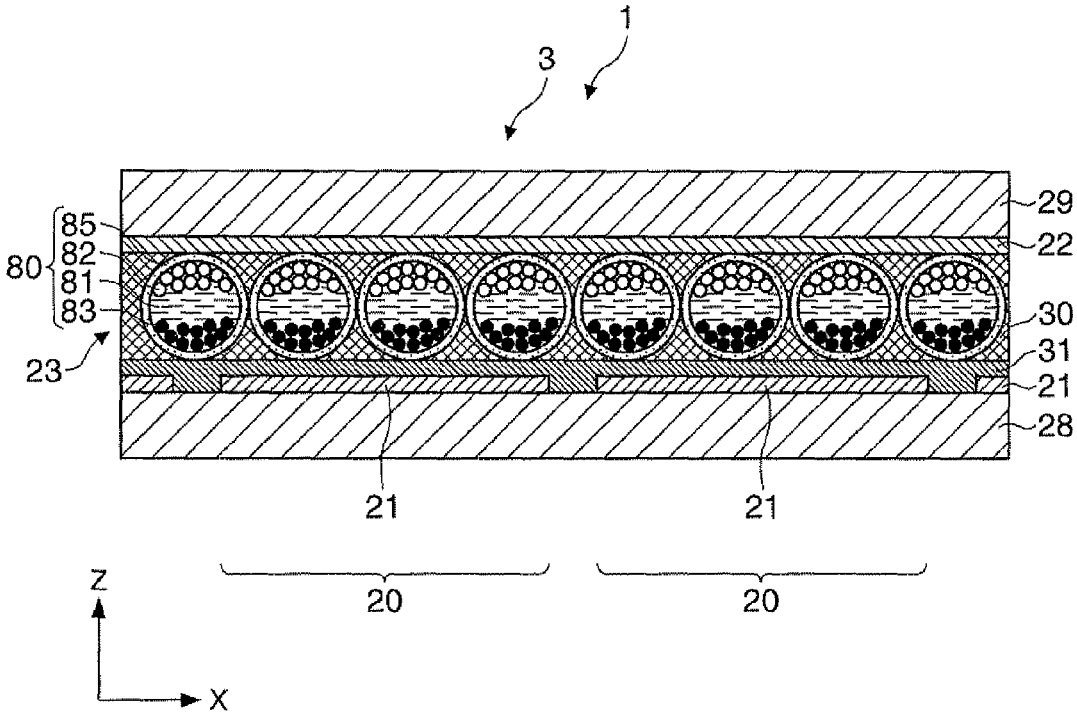
FIG. 4 is a partially sectional view of the display unit of the electrophoretic display device according to the first embodiment.

FIG. 4 is a partially sectional view of the display unit 3 of the electrophoretic display device 1 according to the first embodiment.

Referring to FIG. 4, the display unit 3 has a configuration in which the electrophoretic element 23 is interposed between an element substrate 28 and a counter substrate 29. In addition, the present embodiment will be described on the assumption that an image is displayed on the counter substrate 29 side.

The element substrate 28 is a substrate formed of glass or plastic, for example. Although not shown herein, a laminated structure of the pixel switching transistor 24, the holding capacitor 27, the scanning line 40, the data line 50, the common potential line 93, and the like described above with reference to FIG. 2 is formed on the element substrate 28. A plurality of pixel electrodes 21 are provided in a matrix on the upper layer side of the laminated structure.

The counter substrate 29 is a transparent substrate formed of glass or plastic, for example. On a surface of the counter substrate 29 facing the element substrate 28, the counter electrode 22 is formed in a solid shape so as to face the plurality of pixel electrodes 9*a*. The counter electrode 22 is formed of a transparent conductive material, such as magnesium silver (MgAg), an indium tin oxide (ITO), or an indium zinc oxide (IZO), for example.

The electrophoretic element 23 is formed by a plurality of microcapsules 80 including electrophoretic particles, and is fixed between the element substrate 28 and the counter substrate 29 by an adhesive layer 31 and a binder 30, such as a resin, for example. In addition, the electrophoretic display device 1 according to the present embodiment is formed by bonding an electrophoretic sheet, in which the electrophoretic element 23 is fixed to the counter substrate 29 side in advance by the binder 30, to the element substrate 28 side manufactured separately, on which the pixel electrode 21 and the like are formed, with the adhesive layer 31 in the manufacturing process.

The microcapsule 80 is interposed between the pixel electrode 21 and the counter electrode 22. One or a plurality of microcapsules 80 are disposed in one pixel 20 (in other words, for one pixel electrode 21).

Each microcapsule 80 includes a dispersion medium 81, a plurality of white particles 82, and a plurality of black particles 83 inside a coat 85. The microcapsule 80 is formed in a spherical shape with a particle diameter of about 50 μm, for example.

The coat 85 functions as an outer shell of the microcapsule 80, and is formed of acrylic resin such as polymethylmethacrylate and polyethylmethacrylate, urea resin, or light-transmissive polymer resin such as gum arabic or gelatin.

The dispersion medium 81 is a medium which disperses the white particles 82 and the black particles 83 in the microcapsule 80 (that is, inside the coat 85). As the dispersion medium 81, a single or a mixture of the following materials maybe used: water; alcohol solvents such as methanol, ethanol, isopropanol, butanol, octanol and methyl cellosolve; esters such as ethyl acetate and butyl acetate; ketones such as acetone, methyl ethyl ketone and methyl isobutyl ketone; aliphatic hydrocarbons such as pentane, hexane and octane; alicyclic hydrocarbons such as cyclohexane and methylcyclohexane; aromatic hydrocarbons such as benzenes having a long-chain alkyl group, involving benzene, toluene, xylene, hexyl benzene, butyl benzene, octyl benzene, nonyl benzene, decyl benzene, undecyl benzene, dodecyl benzene, tridecyl benzene, and tetradecyl benzene; halogenated hydrocarbons such as methylene chloride, chloroform, carbon tetrachloride, and 1,2-dichloroethane; carboxylates; and other various oils. In addition, surfactant may be blended with the dispersion medium 81.

The white particle 82 is a particle (polymer or colloid) formed of a white pigment, such as a titanium dioxide, zinc white (zinc oxide), or an antimony trioxide, for example. In addition, the white particle 82 is negatively charged, for example.

The black particle 83 is a particle (polymer or colloid) formed of a black pigment, such as aniline black or carbon black, for example. In addition, the black particle 83 is positively charged, for example.

For this reason, the white particles 82 and the black particles 83 can move in the dispersion medium 81 due to the electric field generated by the potential difference between the pixel electrode 21 and the counter electrode 22.

The following agents may be added to these pigments when necessary. That is, it is possible to add a charge controlling agent made of particles of an electrolyte, surfactant, metal soap, resin, rubber, oil, varnish, compound, or the like, a dispersing agent such as a titanium coupling agent, an aluminum coupling agent, and a silane coupling agent, a lubricating agent, a stabilizing agent, and so forth.

In FIG. 4, when a voltage is applied between the pixel electrode 21 and the counter electrode 22 such that the electric potential of the counter electrode 22 becomes relatively high, the positively charged black particles 83 are attracted to the pixel electrode 21 side within the microcapsule 80 by the Coulomb force, and the negatively charged white particles 82 are attracted to the counter electrode 22 side within the microcapsule 80 by the Coulomb force. As a result, the white particles 82 gather on the display surface side (that is, the counter electrode 22 side) within the microcapsule 80, and the color (that is, white color) of the white particles 82 is displayed on the display surface of the display unit 3. On the contrary, when a voltage is applied between the pixel electrode 21 and the counter electrode 22 such that the electric potential of the pixel electrode 21 becomes relatively high, the negatively charged white particles 82 are attracted to the pixel electrode 21 side by the Coulomb force, and the positively charged black particles 83 are attracted to the counter electrode 22 side by the Coulomb force. As a result, the black particles 83 gather on the display surface side of the microcapsule 80, and the color (that is, black color) of the black particles 83 is displayed on the display surface of the display unit 3.

In addition, red, green, and blue colors may be displayed by replacing the pigments used for the white particles 82 and the black particles 83 with red, green, and blue pigments, for example.

Next, the specific configuration of the controller according to the present embodiment will be described with reference to FIG. 5.

Figure 5:
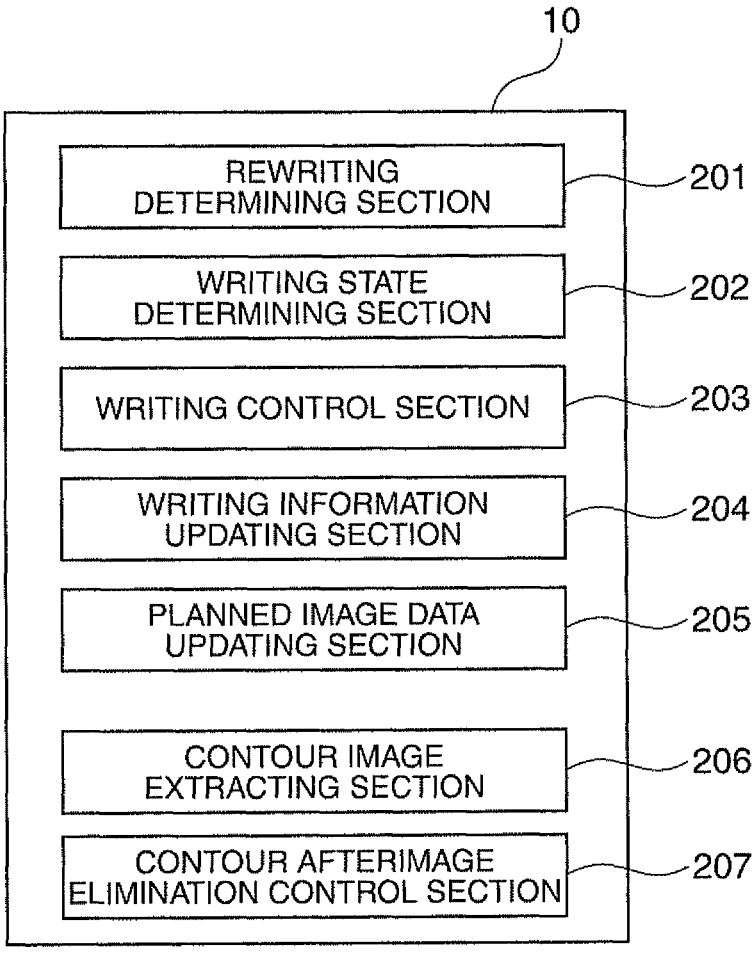
FIG. 5 is a block diagram showing the detailed configuration of a controller according to the first embodiment.

FIG. 5 is a block diagram showing the detailed configuration of the controller according to the first embodiment.

Referring to FIG. 5, the controller 10 is configured to include a rewriting determining section 201, a writing state determining section 202, a writing control section 203, a writing information updating section 204, a planned image data updating section 205, a contour image extracting section 206, and a contour afterimage elimination control section 207.

The rewriting determining section 201 compares the pixel data of a display image stored in the VRAM 4 with the pixel data of a planned image stored in the planned image data storage region 7 for each pixel 20. When the pixel data of a display image stored in the VRAM 4 is different from the pixel data of a planned image stored in the planned image data storage region 7, the rewriting determining section 201 determines that the writing for reflecting the display image data stored in the VRAM 4 (hereinafter, appropriately referred to as "new writing") on the corresponding pixel should be performed.

The writing state determining section 202 determines whether or not a writing operation on each pixel 20 is in progress with reference to the writing information stored in the writing information storage region 6.

When it is determined that new writing to one pixel should be performed and it is also determined that a writing operation on the one pixel is not in progress, the writing control section 203 performs control to start the new writing.

When the new writing starts, the writing information updating section 204 changes the writing information of the pixel to the value indicating that a writing operation is in progress. In addition, when the writing operation in progress ends, the writing information updating section 204 changes the writing information of the pixel to the value indicating that a writing operation is not in progress.

When the new writing starts, the planned image data updating section 205 overwrites the planned image data of the pixel stored in the planned image data storage region with the pixel data of the display image stored in the VRAM 4.

The contour image extracting section 206 is an example of an "extraction section" according to the invention, and extracts a contour image, which forms a contour afterimage, from the pixel data before rewriting and the pixel data after rewriting. The contour image will be described in detail later.

The contour afterimage elimination control section 207 is an example of a "contour elimination section" according to the invention, and performs control to apply a voltage for eliminating a contour image to a contour display pixel which displays the contour image.

Next, an operation when rewriting an image in the electrophoretic display device according to the present embodiment will be described with reference to FIGS. 6 and 7. For convenience of explanation, an operation for eliminating a contour afterimage will be omitted, and only an operation for rewriting an image will be described in detail. In addition, the operation of eliminating a contour afterimage will be described in detail later.

Figure 6:
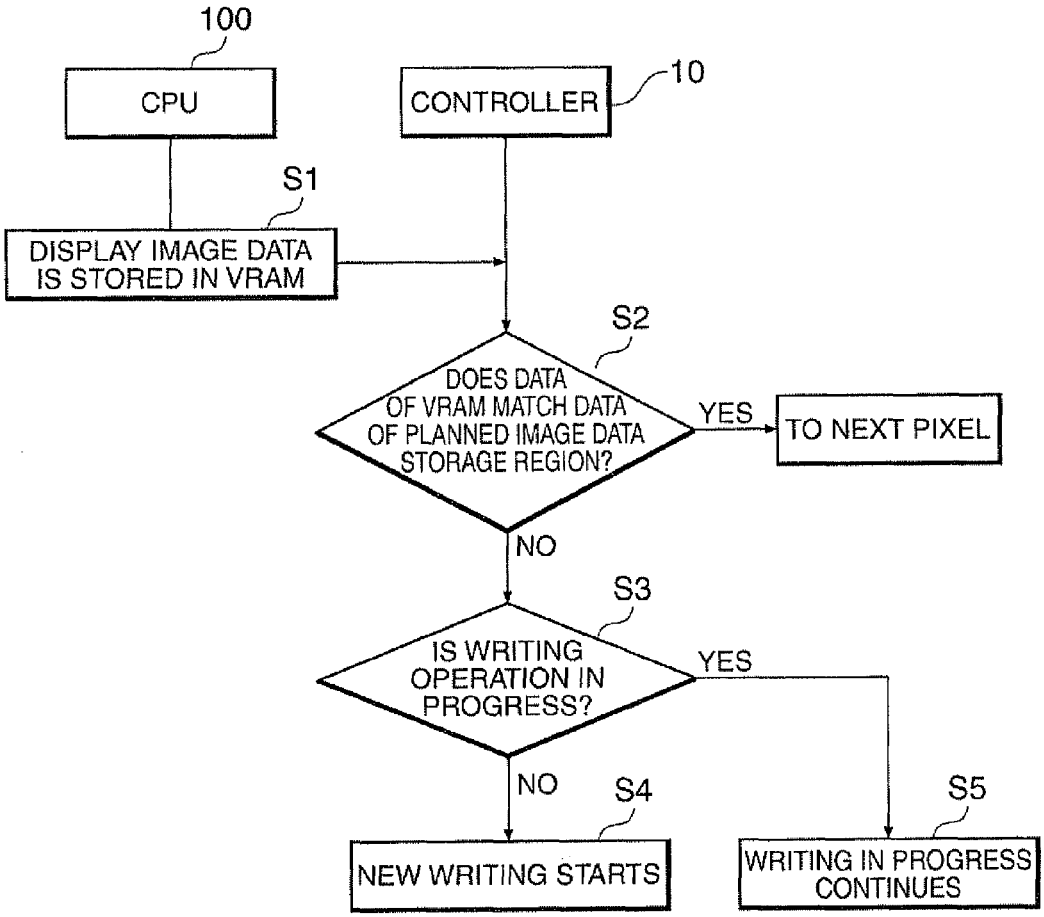
FIG. 6 is a flow chart showing the schematic operation of the electrophoretic display device according to the first embodiment.

FIG. 6 is a flow chart showing the schematic operation of the electrophoretic display device according to the first embodiment.

Referring to FIG. 6, when the operation of the electrophoretic display device according to the first embodiment starts, the CPU 100 stores the display image data displayed on the display unit 3 in the VRAM 4 first (step Si).

Then, the rewriting determining section 201 of the controller 10 determines, for one pixel 20, whether or not the pixel data of the display image stored in the VRAM 4 matches the pixel data of the planned image stored in the planned image data storage region 7 (step S2).

When the pixel data of the display image stored in the VRAM 4 matches the pixel data of the planned image stored in the planned image data storage region 7 (step S2: YES), it is determined that new writing to the one pixel is not necessary, and the process proceeds to processing for the next pixel. On the other hand, when the pixel data of the display image stored in the VRAM 4 is different from the pixel data of the planned image stored in the planned image data storage region 7 (step S2: NO), it is determined that new writing to the one pixel should be performed.

When it is determined that new writing should be performed, the writing state determining section 202 determines whether or not a writing operation on the one pixel 20 is in progress with reference to the writing information stored in the writing information storage region 6 (step S3).

When it is determined that a writing operation is not in progress (step S3: NO), the writing control section 203 starts new writing (step S4). In this case, the writing information updating section 204 changes the writing information of the pixel to the value indicating that a writing operation is in progress. In addition, the planned image data updating section 205 overwrites the planned image data of the pixel, which is stored in the planned image data storage region, with the pixel data of the display image stored in the VRAM 4. On the other hand, when it is determined that a writing operation is in progress (step S3: YES), the writing control section 203 continues the writing operation in progress (step S5). In addition, when the writing operation in progress ends, the writing information updating section 204 changes the writing information of the pixel to the value indicating that a writing operation is not in progress.

Figure 7:
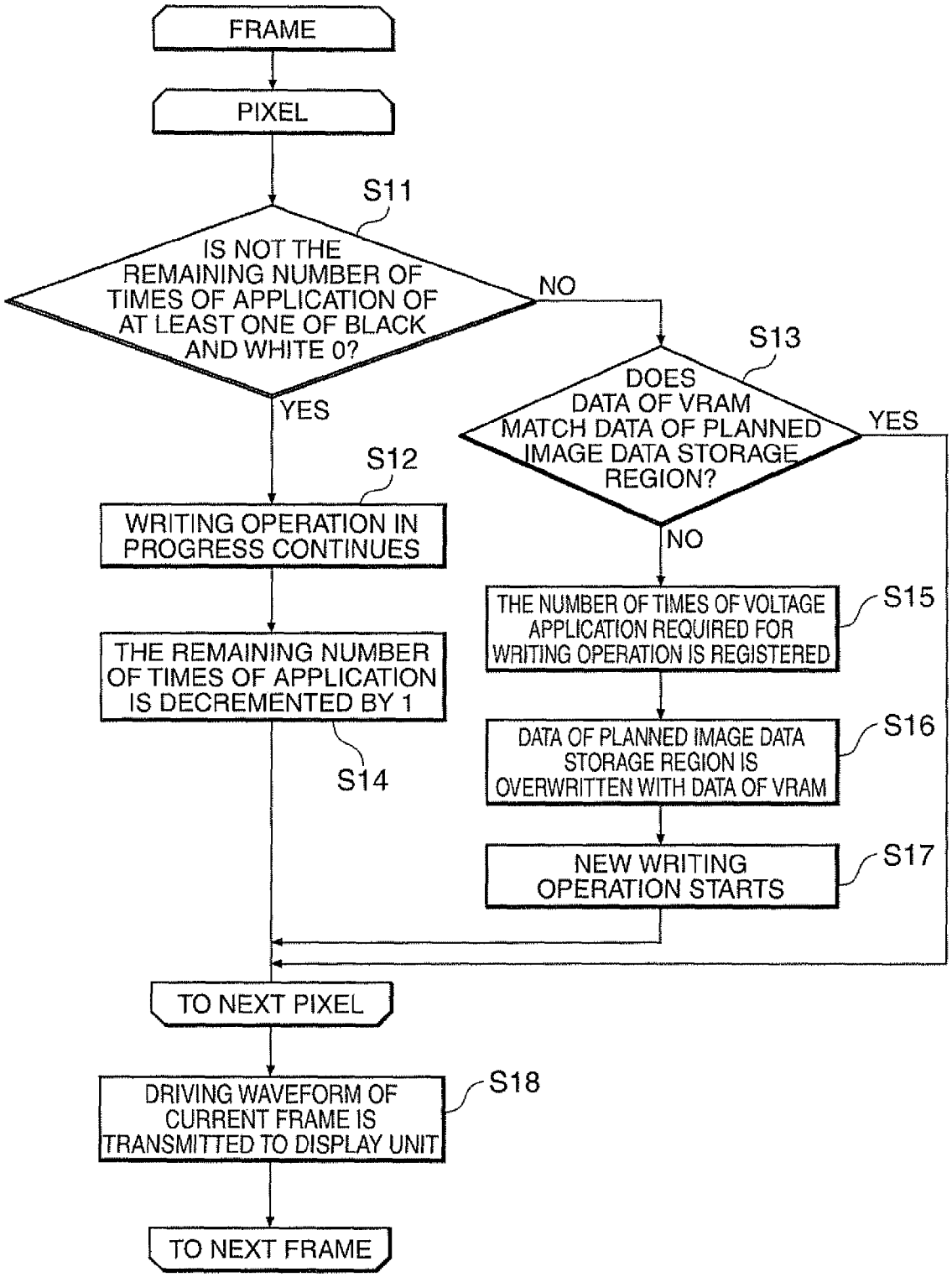
FIG. 7 is a flow chart showing an operation at the time of writing of the controller according to the first embodiment.

FIG. 7 is a flow chart showing an operation at the time of writing of the controller according to the first embodiment.

In addition, it is assumed that the first writing information indicating whether or not a writing operation for changing the display state of each pixel 20 from black to white is in progress and the second writing information indicating whether or not a writing operation for changing the display state of each pixel 20 from white to black is in progress are included in the writing information storage region 6.

In addition, the writing operation for changing the display state of each pixel 20 from white to black or from black to white is assumed to include a plurality of frame periods. Therefore, the writing operation for changing the display state from white to black, for example, includes an operation of supplying a data signal for black display to the pixel 20 multiple times (that is, an operation of supplying a data signal in each of the plurality of frame periods). FIG. 7 shows an operation in one frame period of the plurality of frame periods.

The first and second writing information items described above are values changing with the number of times by which a driving voltage has already been applied in the writing operation. After the last driving voltage application in writing, the writing information items become values indicating that the writing information is not in progress. Here, the writing information is assumed to be the remaining number of times of application until the writing ends. Therefore, the remaining number of times of application "0" is equivalent to the value indicating that a writing operation is not in progress, and values other than "0" are equivalent to the value indicating that a writing operation is in progress. In addition, the writing information storage region 6 is an example of a "number-of-times storage section" according to the invention.

Referring to FIG. 7, when the operation of the electrophoretic display device according to the first embodiment starts, the first and the second writing information items (that is, the remaining number of times of application) stored in the writing information storage region 6 is first referred to for the one pixel 20 by the writing state determining section 202 (step S11).

When at least one value of the first and second writing information items is not "0" (step S11: YES), the writing control section 203 continues the writing operation in progress (step S12). Then, the writing information updating section 204 decrements the value of the remaining number of times of application whenever voltage application is performed once (step S14). That is, the writing information updating section 204 is an example of a "decrement section" according to the invention.

On the other hand, when the values of both the first and second writing information items are "0" (step S11; NO), the rewriting determining section 201 determines whether or not the pixel data of the display image of the pixel 20 stored in the VRAM 4 matches the pixel data of the planned image stored in the planned image data storage region 7 (step S13).

When the pixel data of the display image of the pixel 20 stored in the VRAM 4 is different from the pixel data of the planned image stored in the planned image data storage region 7 (step S13: NO), the writing information updating section 204 registers the number of times of voltage application required for the writing operation in the writing information storage region 6 (step S15). Then, the planned image data updating section 205 overwrites the planned image data stored in the planned image data storage region 7 of the pixel 20 with the pixel data of the display image stored in the VRAM 4 (step S16). Then, the writing control section 203 starts a new writing operation (step S17).

After performing the above operation for all pixels 20, the controller 10 transmits a driving waveform in the current frame period to the display unit 3 (step S18).

Next, the image rewriting operation of the electrophoretic display device 1 according to the present embodiment will be described more specifically with reference to FIGS. 8 to 15.

FIGS. 8 to 15 are conceptual views showing a method of voltage application to each pixel of the electrophoretic display device according to the first embodiment. Moreover, in FIGS. 8 to 15, some pixels in the display unit 3 are shown as Pij (where i represents a row number and j represents a column number). In each pixel Pij, the gray level is expressed in eight steps of "0" corresponding to black to "7" corresponding to white.

A white writing information storage region 6A showing whether or not a writing operation for changing the display state of each pixel from black to white is in progress and a black writing information storage region 6B showing whether or not a writing operation for changing the display state of each pixel from white to black is in progress is included in the writing information storage region 6.

A storage region Mij corresponding to the pixel Pij of the display unit 3 is set in each of the VRAM 4, the white writing information storage region 6A, the black writing information storage region 6B, and the planned image data storage region 7.

The pixel data (that is, gray level) of the display image is stored in the storage region Mij of the VRAM 4, and the pixel data (that is, gray level) of the planned image is stored in the storage region Mij of the planned image data storage region 7.

The number of times of voltage application (0 to 7) required until each pixel Pij is displayed in white is stored in the storage region Mij of the white writing information storage region 6A, and the number of times of voltage application (0 to 7) required until each pixel Pij is displayed in black is stored in the storage region Mij of black writing information storage region 6B. In addition, the number of times of voltage application may be replaced with the number of frames for applying a voltage.

Figure 8:
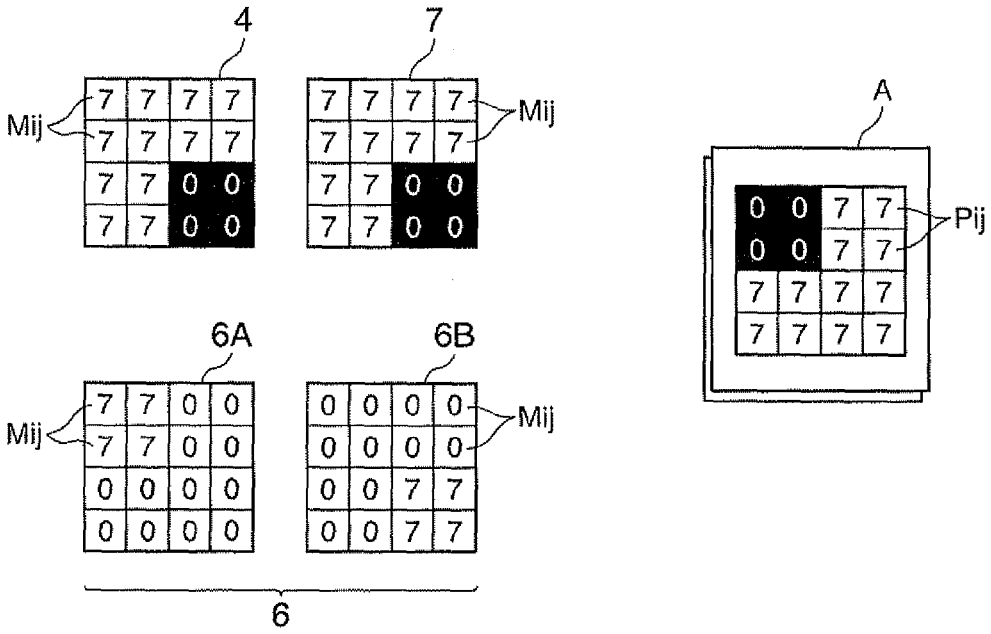
FIG. 8 is a conceptual diagram showing a method for applying a voltage to each pixel of the electrophoretic display device according to the first embodiment.

In the state shown in FIG. 8, rewriting from a display image A to a planned image stored in the planned image data storage region 7 is in progress, and pixels P11, P12, P21, and P22 are rewritten from black to white. Accordingly, the remaining number of times "7" is set in storage regions M11, M12, M21, and M22 of the white writing information storage region 6A. Similarly, since pixels P33, P34, P43, and P44 are rewritten from white to black, the remaining number of times "7" is set in storage regions M33, M34, M43, and M44 of the black writing information storage region 6B.

Figure 9:
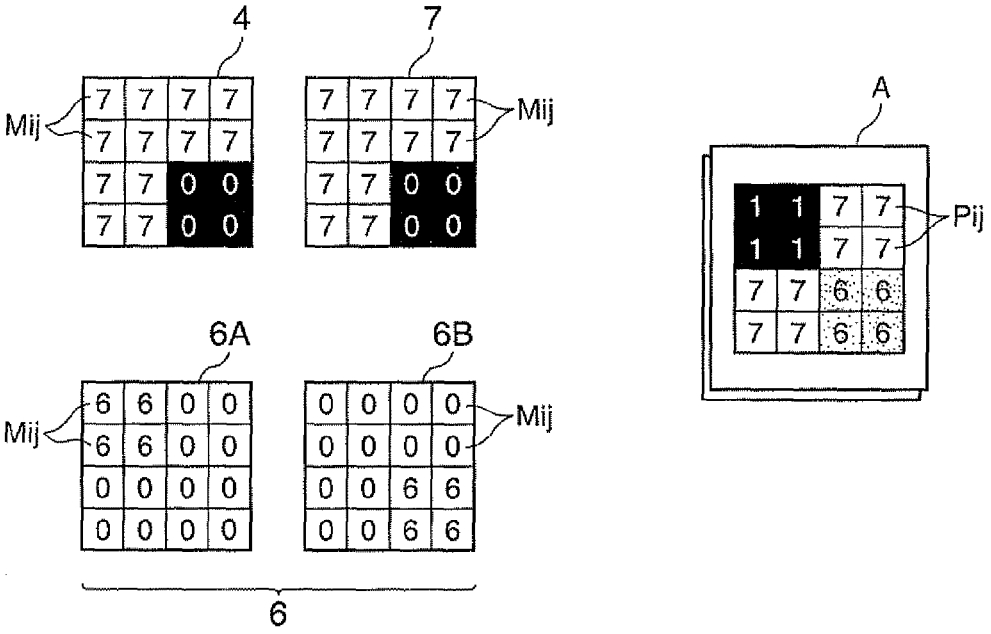
FIG. 9 is a conceptual diagram showing a method for applying a voltage to each pixel of the electrophoretic display device according to the first embodiment.

FIG. 9 shows a state when one writing operation has ended from the state shown in FIG. 8, that is, a state when a writing operation of one frame has ended. In FIG. 9, the pixels P11, P12, P21, and P22 are modulated by one gray level in the direction of white, and the pixels P33, P34, P43, and P44 are modulated by one gray level in the direction of black. In addition, the remaining number of times of the storage regions M11, M12, M21, and M22 of the white writing information storage region 6A and the remaining number of times of the storage regions M33, M34, M43, and M44 of the black writing information storage region 6B are reduced by 1 to become "6".

Thus, whenever one writing operation is performed, the gray level of the pixel Pij is modulated by one step, and the remaining number of times of the white writing information storage region 6A and the remaining number of times of the black writing information storage region 6B are also reduced by 1.

Figure 10:
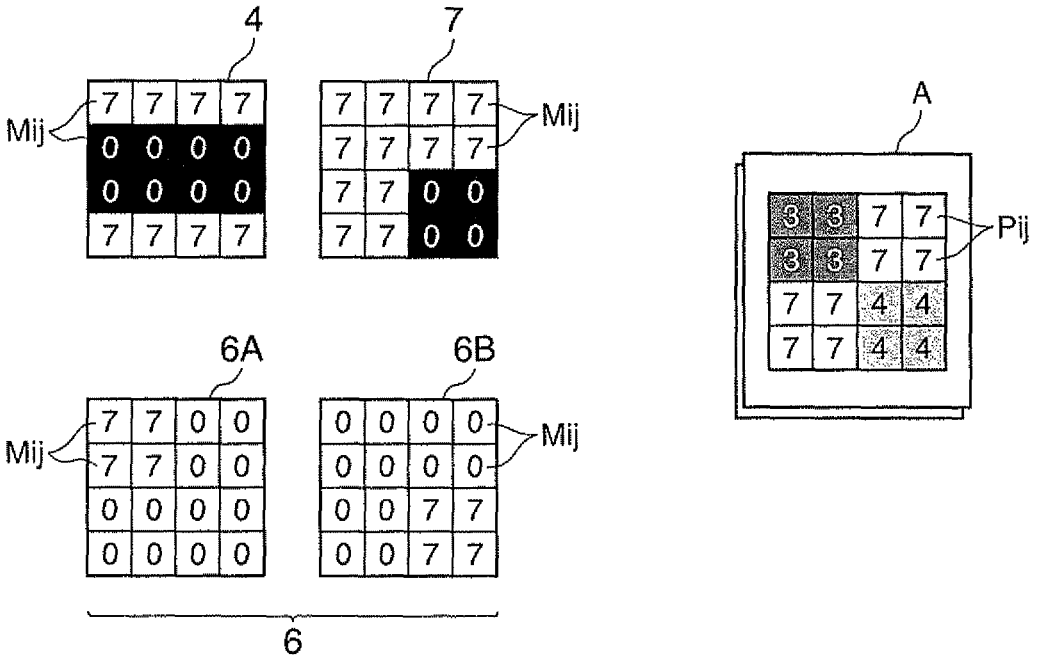
FIG. 10 is a conceptual diagram showing a method for applying a voltage to each pixel of the electrophoretic display device according to the first embodiment.

FIG. 10 shows a state when a third writing operation has ended from the state shown in FIG. 8. At this timing, a case is considered in which the CPU 100 changes the image data of the VRAM 4 as shown in FIG. 10.

In this case, the writing state determining section 202 refers to the remaining number of times of the white writing information storage region 6A and the remaining number of times of the black writing information storage region 6B for each pixel Pij. As a result, the writing state determining section 202 determines that the writing operation is in progress for the pixels P11, P12, P21, P22, P33, P34, P43, and P44 and the writing operation is not in progress for the other pixels.

For each pixel Pij, the rewriting determining section 201 compares the pixel data stored in the storage region Mij of the VRAM 4 with the pixel data stored in the storage region Mij of the planned image data storage region 7. As a result, it is determined that the pixel data stored in the storage region Mij of the VRAM 4 is different from the pixel data stored in the storage region Mij of the planned image data storage region 7 for the pixels P21, P22, P23, P24, P31, P32, P43, and P44, and it is determined that the pixel data stored in the storage region Mij of the VRAM 4 is the same as the pixel data stored in the storage region Mij of the planned image data storage region 7 for the other pixels.

From the above result, for the pixels P11, P12, P21, P22, P33, P34, P43, and P44 on which a writing operation is in progress, the writing control section 203 continues the writing operation which is currently in progress.

In addition, for the pixels P23, P24, P31, and P32 on which a writing operation is not in progress currently and in which images of the VRAM 4 are different from images of the planned image data storage region 7, the writing information updating section 204 updates the writing information storage region 6. Specifically, since the rewriting from white to black should be performed for the pixels P23, P24, P31, and P32, the storage regions M23 and M24 of the black writing information storage region 6B are set to "7".

In addition, for the pixels P23, P24, P31, and P32, the planned image data updating section 205 overwrites the storage region Mij of the planned image data storage region 7 with the data of the storage region Mij of the VRAM 4.

Figure 11:
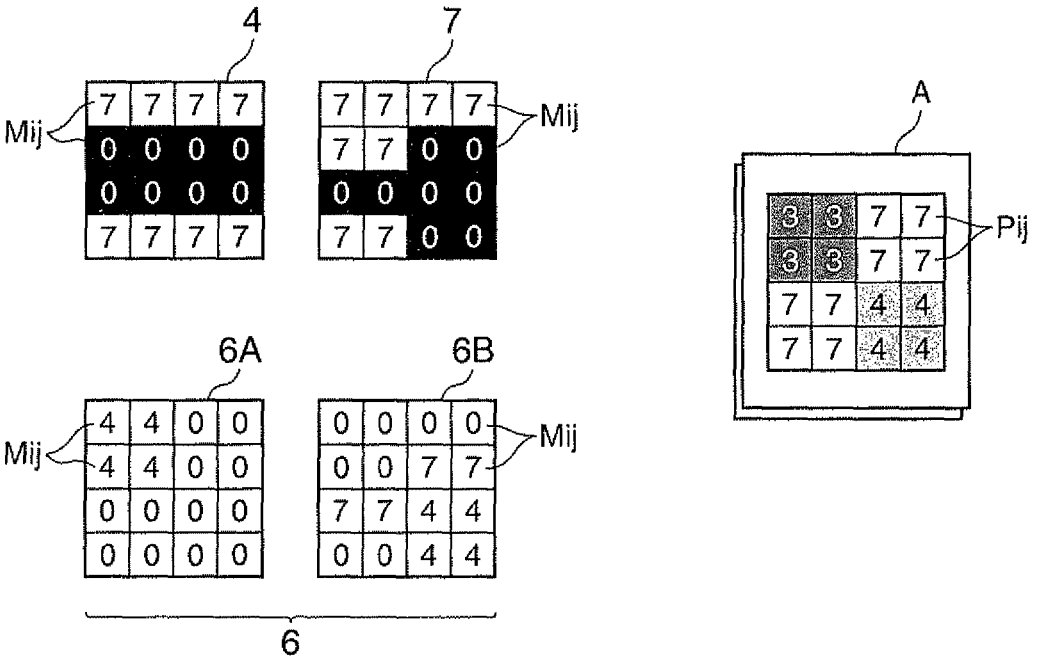
FIG. 11 is a conceptual diagram showing a method for applying a voltage to each pixel of the electrophoretic display device according to the first embodiment.

As a result, the white writing information storage region 6A, the black writing information storage region 6B, and the planned image data storage region 7 are in the states shown in FIG. 11.

As shown in FIG. 11, according to the information of the white writing information storage region 6A and the black writing information storage region 6B after updating, the writing control section 203 continues the writing operation in progress for the pixels P11, P12, P21, P22, P33, P34, P43, and P44 and starts a new writing operation for the pixels P23, P24, P31, and P32.

Figure 12:
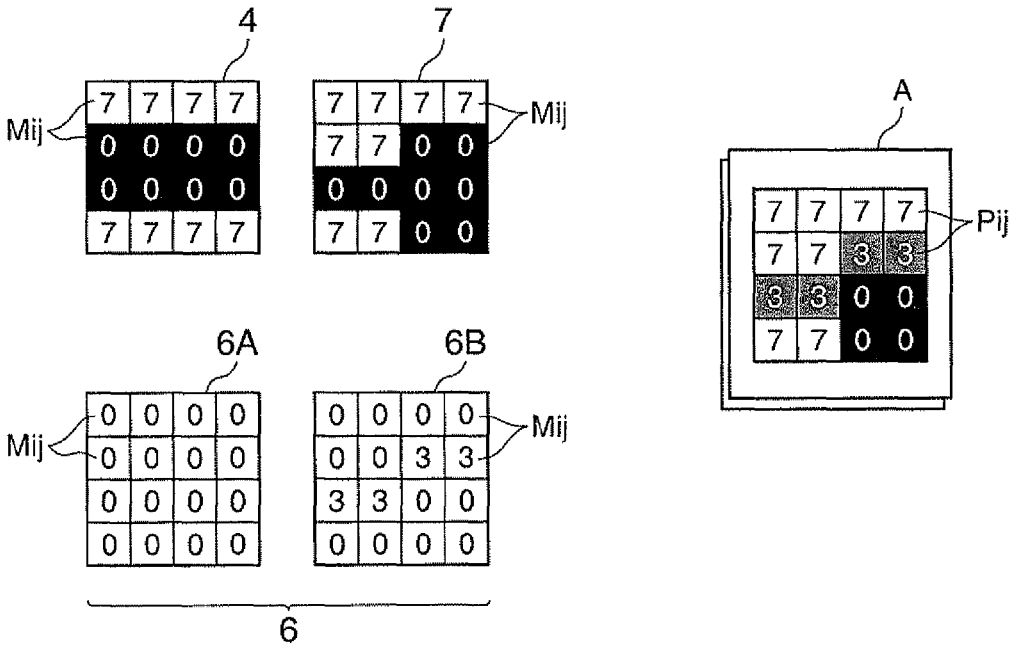
FIG. 12 is a conceptual diagram showing a method for applying a voltage to each pixel of the electrophoretic display device according to the first embodiment.

FIG. 12 shows a state when a writing operation has ended four times from the state shown in FIG. 11. As shown in FIG. 12, the writing operation has ended for the pixels P11, P12, P21, P22, P33, P34, P43, and P44, and the writing operation is in progress for the pixels P23, P24, P31, and P32.

Here, the writing state determining section 202 determines that the writing operation on the pixels P11, P12, P21, P22, P33, P34, P43, and P44 is not in progress. In addition, for the pixels P23, P24, P31, and P32, the rewriting determining section 201 determines that the pixel data of the storage region Mij of the VRAM 4 does not match the pixel data of the storage region Mij of the planned image data storage region 7.

Accordingly, the writing information updating section 204 updates the writing information storage region 6 for the pixels P23, P24, P31, and P32. Specifically, since the rewriting from white to black should be performed for the pixels P21 and P22, the storage regions M21 and M22 of the black writing information storage region 65 are set to "7". In addition, since the rewriting from black to white should be performed for the pixels P43 and P44, the storage regions M43 and M44 of the white writing information storage region 6A are set to "7".

In addition, for the pixels P21, P22, P43, and P44, the planned image data updating section 205 overwrites the storage region Mij of the planned image data storage region 7 with the data of the storage region Mij of the VRAM 4.

Figure 13:
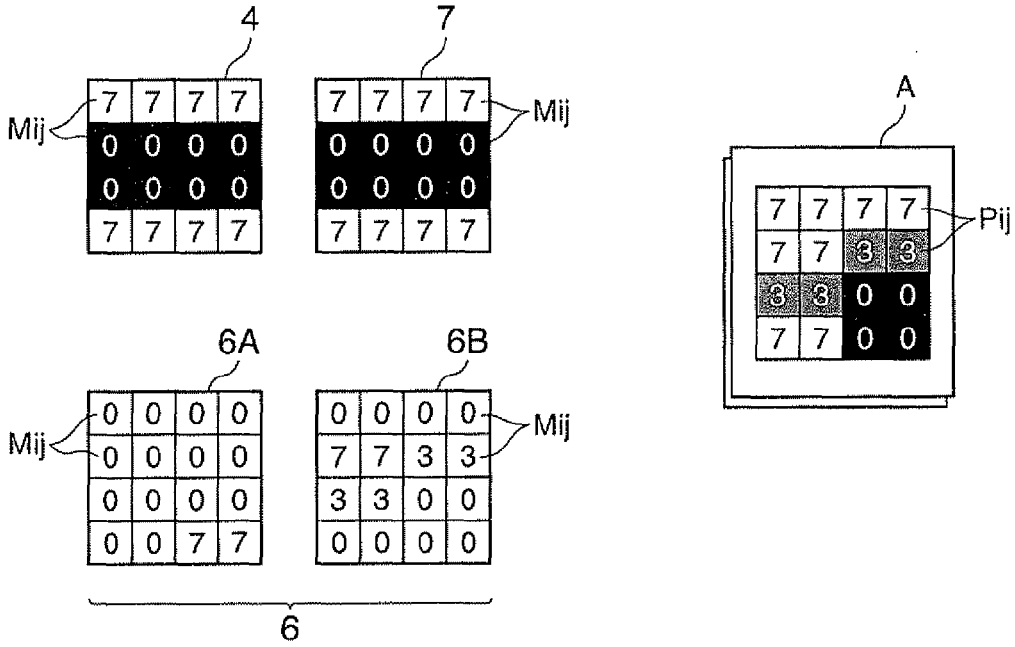
FIG. 13 is a conceptual diagram showing a method for applying a voltage to each pixel of the electrophoretic display device according to the first embodiment.

As a result, the white writing information storage region 6A, the black writing information storage region 6B, and the planned image data storage region 7 are in the states shown in FIG. 13.

As shown in FIG. 13, according to the information of the white writing information storage region 6A and the black writing information storage region 65 after updating, the writing control section 203 continues the writing operation in progress for the pixels P23, P24, P31, and P32 and starts a new writing operation for the pixels P21, P22, P43, and P44.

Figure 14:
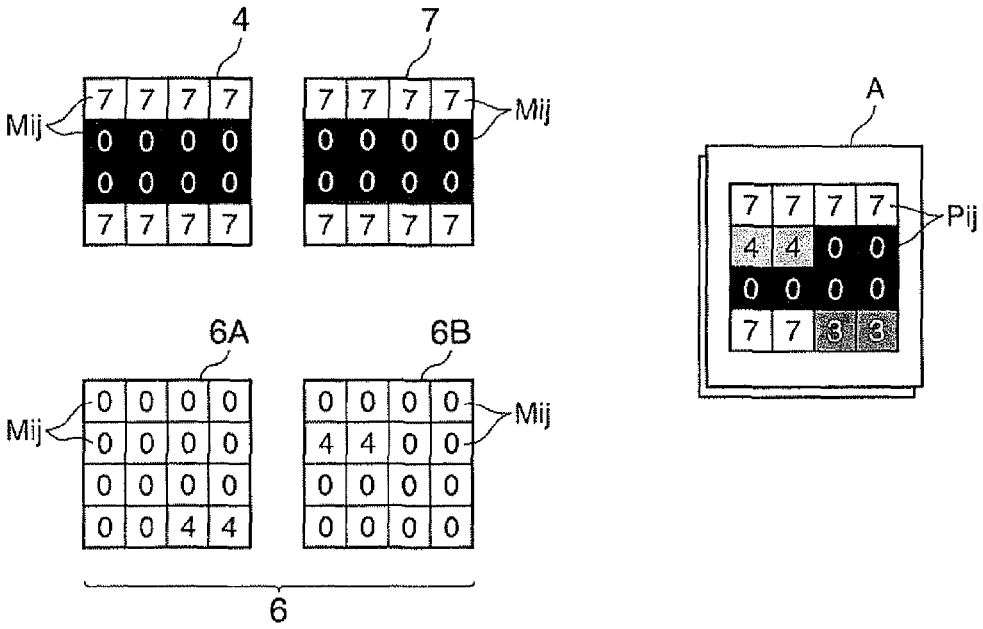
FIG. 14 is a conceptual diagram showing a method for applying a voltage to each pixel of the electrophoretic display device according to the first embodiment.

FIG. 14 shows a state when a writing operation has ended three times from the state shown in FIG. 13. As shown in FIG. 14, the writing operation has ended for the pixels P23, P24, P31, and P32, and the writing operation is in progress for the pixels P21, P22, P43, and P44.

Figure 15:
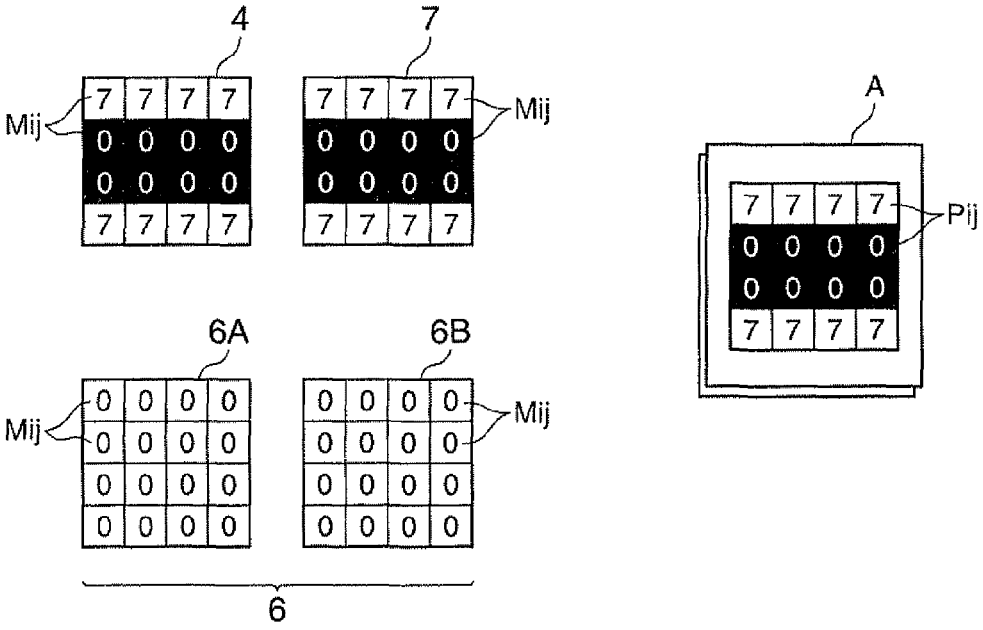
FIG. 15 is a conceptual diagram showing a method for applying a voltage to each pixel of the electrophoretic display device according to the first embodiment.

FIG. 15 shows a state when a writing operation has ended three times from the state shown in FIG. 14. As shown in FIG. 15, the writing operation has also ended for the pixels P21, P22, P43, and P44 and accordingly, drawing of the image stored in the VRAM 4 is completed.

In the image rewriting described above, the writing operation for changing the display state of each pixel from black to white or from white to black includes a step (first supply step) of supplying the electric potential corresponding to the changed gray level to the pixel electrode 21 of a pixel (first pixel) whose gray level to be displayed changes. In addition, the writing operation when the display state of each pixel is not changed so as to remain black or white includes a step (second supply step) of supplying the same electric potential as the electric potential of the counter electrode 22 to the pixel electrode 21 of a pixel (second pixel) whose gray level to be displayed is not changed. In addition, the controller 10, the scanning line driving circuit 60, and the data line driving circuit 70 are examples of a first supply section which performs the above-described first supply step and a second supply section which performs the above-described second supply step.

As described above, in the electrophoretic display device 1 according to the first embodiment, it is determined in units of a pixel whether or not a writing operation is in progress, and a new writing operation starts from a pixel to which writing has ended when necessary. Therefore, in the electrophoretic display device which takes a relatively long time to rewrite an image, it is possible to improve the perceived response speed of image display. In particular, in the present embodiment, it is possible to determine in units of a pixel whether or not a writing operation is in progress, as described above. Accordingly, a contour afterimage elimination operation, which will be described in detail below, can be performed.

Figure 16:
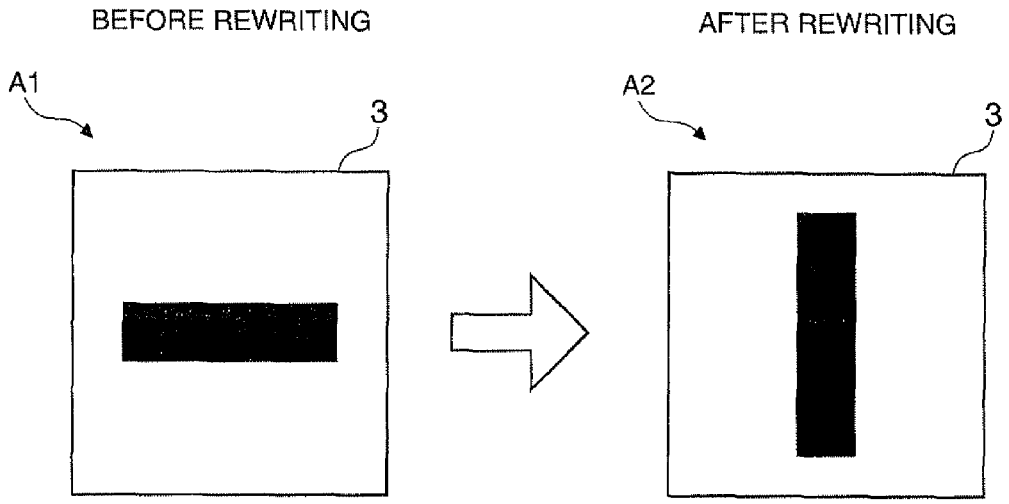
FIG. 16 is a plan view showing an example of an image before rewriting and an image after rewriting.

Hereinafter, the contour afterimage elimination operation will be described with reference to FIGS. 16 to 24. Here, a contour afterimage elimination operation when an image displayed on the display unit 3 is rewritten from an image A1 to an image A2 as shown in FIG. 16 will be described as an example. FIG. 16 is a plan view showing an example of the image A1 before rewriting and the image A2 after rewriting.

Figure 17:
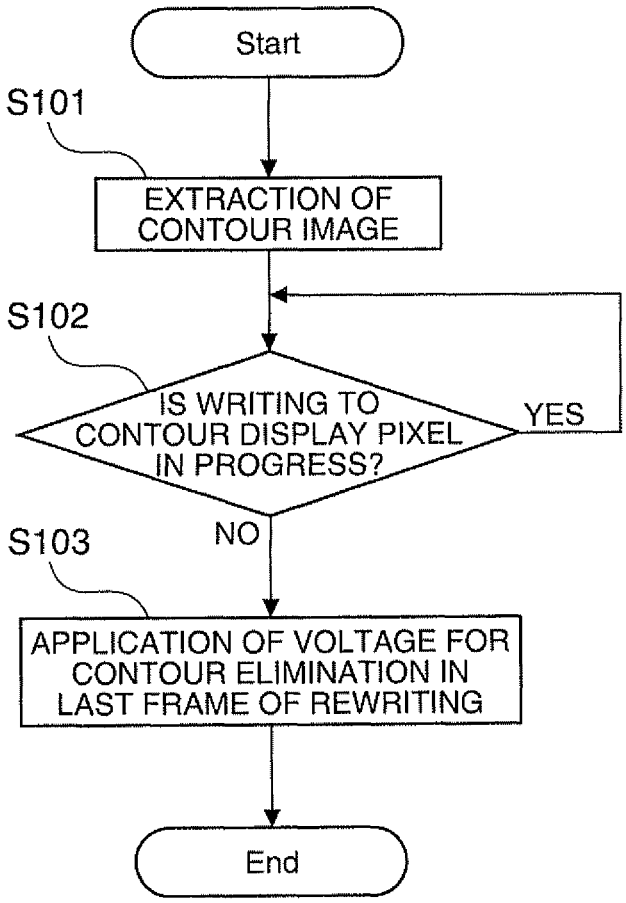
FIG. 17 is a flow chart showing a contour afterimage elimination operation in the electrophoretic display device according to the first embodiment.

FIG. 17 is a flow chart showing the contour afterimage elimination operation in the electrophoretic display device according to the first embodiment.

Referring to FIG. 17, when the contour afterimage elimination operation starts, the contour image extracting section 206 extracts a contour image which forms a contour afterimage first (step S101). In addition, step S101 is an example of an "extraction step" according to the invention. A contour image is extracted on the basis of a difference image of the image A1 before rewriting and the image A2 after rewriting, for example.

Figures 18, 19:
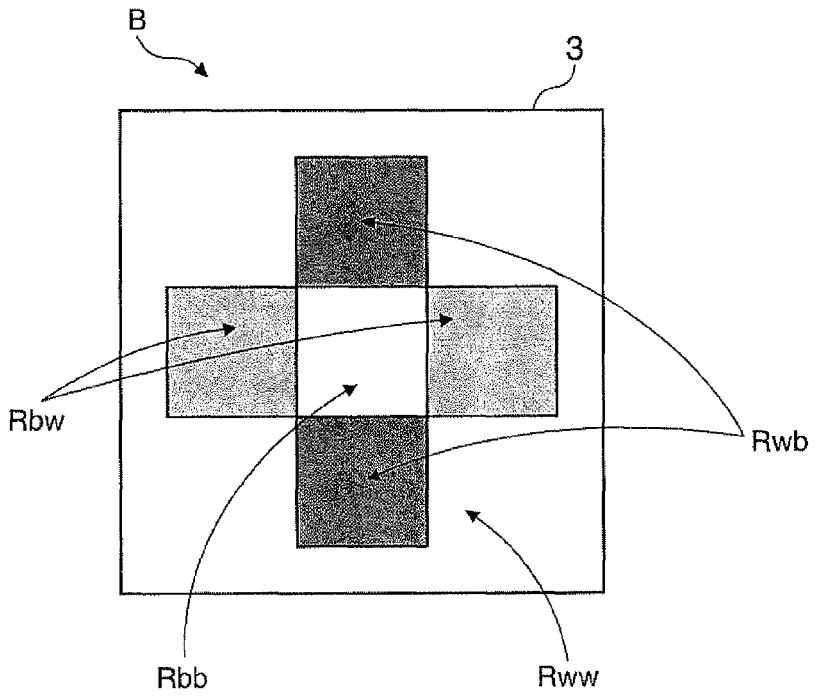
FIG. 18 is a plan view showing an example of a difference image of an image before rewriting and an image after rewriting.
FIG. 19 is a table showing a voltage, which is applied to a pixel at the time of image rewriting, for each region.

FIG. 18 is a plan view showing an example of the difference image of the image before rewriting and the image after rewriting.

As shown in FIG. 18, a difference image B of the image A1 before rewriting and the image A2 after rewriting is divided into a region Rww where the gray level before rewriting is white and white is maintained even after rewriting, a region Rbb where the gray level before rewriting is black and black is maintained even after rewriting, a region Rwb where the gray level before rewriting is white and the gray level after rewriting is black, and a region Rbw where the gray level before rewriting is black and the gray level after rewriting is white.

FIG. 19 is a table showing a voltage, which is applied to a pixel at the time of image rewriting, for each region.

As shown in FIG. 19, a voltage for rewriting an image is applied to the pixel 20 in each of the regions Rww, Rbb, Rwb, and Rbw. Specifically, 0 V which is a reference potential GND is applied to the regions Rww and Rbb where the gray level should be maintained. In addition, since a voltage is not substantially applied to the regions Rww and Rbb, the number of frames in which a voltage is applied is "0". In addition, +15 V which is a high potential VH corresponding to black is applied to the region Rwb where the gray level should be changed from white to black over 7 frames. In addition, −15 V which is a low potential VL corresponding to white is applied to the region Rbw where the gray level should be changed from black to white over 7 frames.

In the above-described driving method of rewriting an image partially, an afterimage may be left in a contour portion of the eliminated image due to blurring which occurs at the time of image rewriting. Hereinafter, the principle of the occurrence of blurring will be described with reference to FIG. 20.

Figure 20:
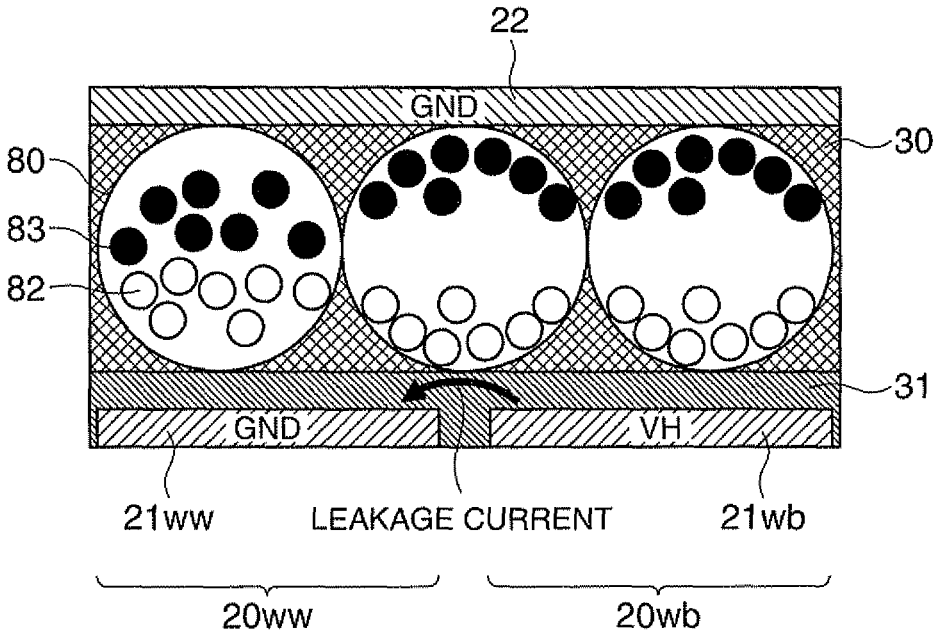
FIG. 20 is a schematic view for explaining the occurrence of blurring of the boundary in a display image.

FIG. 20 is a schematic view for explaining the occurrence of blurring of the boundary in an image displayed on a display unit.

As shown in FIG. 20, when the reference potential GND as data potential is supplied to a pixel electrode 21*ww* of a pixel 20*ww* corresponding to the region Rww (that is, a region where the gray level to be displayed is not changed so as to remain white) and the high potential VH as data potential is supplied to a pixel electrode 21*wb* of a pixel 20*wb* corresponding to the region Rwb (that is, a region where the gray level to be displayed changes from white to black) adjacent to the pixel 20*ww*, a leakage current may be generated between the pixel electrode 21*wb* and the pixel electrode 21*ww* when the pixel switching transistor 24 (refer to FIG. 2) is turned off. As a result, the electric potential of the pixel electrode 21*ww* which has been the reference potential GND may rise (that is, may become close to the high potential VH). Accordingly, in the pixel 20*ww*, the black particles 83 may move to the counter electrode 22 side and the white particles 82 may move to the pixel electrode 21*ww* side due to the potential difference between the pixel electrode 21*ww* and the counter electrode 22. Then, in the pixel 20*ww* to be displayed white, a different color from white, such as gray or black, may be displayed. As a result, the boundary of a black image portion and a white image portion in the image displayed on the display unit 3 may be blurred.

Figures 21, 22:
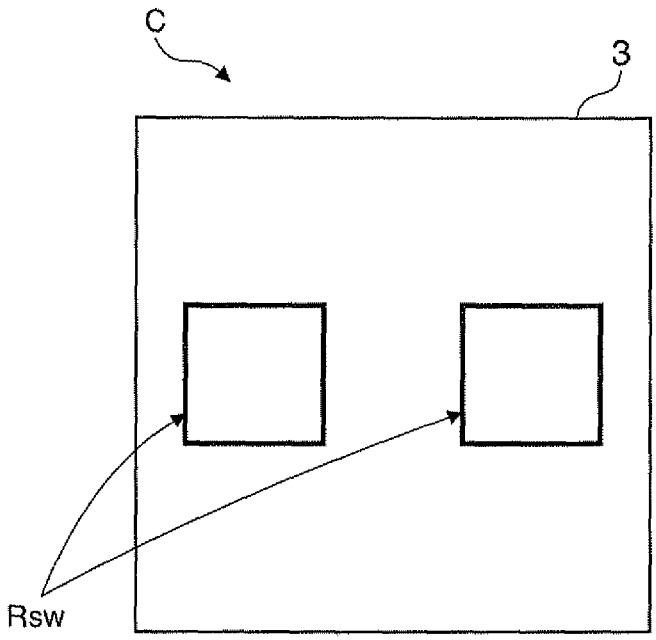
FIG. 21 is a plan view showing an example of a contour image extracted so as to correspond to a contour afterimage.
FIG. 22 is a table showing a voltage, which is applied to a contour display pixel at the time of contour elimination operation, for each region.

FIG. 21 is a plan view showing an example of a contour image extracted so as to correspond to a contour afterimage.

In FIG. 21, a blur located in the region Rww among the blurs described above is not eliminated since a voltage is not applied. For this reason, in the image A2 after rewriting, a contour afterimage may be generated in a region Rsw shown in a contour image C. In addition, the region Rsw may be extracted as a region surrounding the region Rbw in the difference image B.

Referring back to FIG. 17, after a contour afterimage is extracted, the writing state determining section 202 determines whether or not a contour display pixel corresponding to the contour image is being written (step S102). The writing state determining section 202 determines whether or not a contour display pixel is being written using the value stored in the writing information storage region 6 as described above. In addition, step S102 is an example of a "determination step" according to the invention, and the writing state determining section 202 is an example of a "determination section" according to the invention.

Here, when it is determined that a contour display pixel is not being written (step S102: NO), the contour afterimage elimination control section 207 applies a voltage for eliminating the contour afterimage to the contour display pixel (hereinafter, appropriately referred to as a "contour elimination voltage") (step S103). In addition, step S103 is an example of a "contour elimination step" according to the invention. Hereinafter, the contour elimination voltage will be specifically described with reference to FIG. 22.

FIG. 22 is a table showing a voltage, which is applied to a contour display pixel at the time of contour elimination operation, for each region.

In FIG. 22, −15 V which is the low potential VL corresponding to white is applied to the region Rsw, in which a contour image is displayed but white should be displayed originally, as the contour elimination voltage in only one frame. In addition, although not illustrated in the contour image C shown in FIG. 21, +15 V which is the high potential VH corresponding to black is applied to the region Rsb, in which a contour image is displayed but black should be displayed originally, as the contour elimination voltage in only one frame. Specifically, the value of the white writing information storage region 6A or the black writing information storage region 6B is changed from "0" to "1". In addition, the contour elimination voltage is applied in only one frame, unlike the above-described voltage applied at the time of image rewriting. Therefore, it is possible to suppress or prevent inconsistency in the DC balance ratio in each pixel 20.

Application of the contour elimination voltage may be performed immediately after it is determined that a contour display pixel is not being written in the determination (that is, step S102) of the writing state determining section 202, or may be performed according to the rewriting timing of pixels adjacent to each other. For example, the contour elimination voltage may be applied to a contour display pixel according to the last frame period of image rewriting performed for a pixel adjacent to the contour display pixel (that is, the last frame period of seven frames necessary for image rewriting).

More specifically, when the value of the white writing information storage region 6A or the black writing information storage region 6B corresponding to the pixel adjacent to the contour display pixel is gradually decreased from "7" by the application of the voltage to change from "2" to "1", the value of the white writing information storage region 6A or the black writing information storage region 6B corresponding to the contour display pixel changes from "0" to "1". Since the contour afterimage is eliminated simultaneously with the end of image rewriting if the contour elimination voltage is applied as described above, it is possible to make the contour afterimage even less visible.

In addition, when the writing state determining section 202 determines that the contour display pixel is being written (step S102: YES), an electric potential for eliminating the contour image is supplied in a frame period after the writing to the contour display pixel ends. For this reason, in a phase in which the contour elimination voltage should be applied, a contour afterimage can be reliably eliminated as soon as rewriting of an image is completed even if the pixel is a contour display pixel on which image rewriting is performed.

Figure 23:
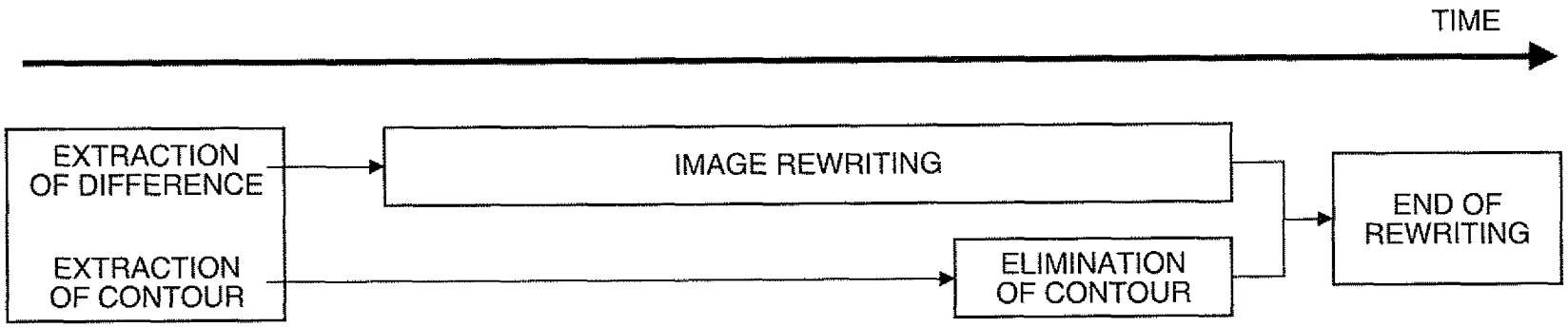
FIG. 23 is a time chart showing the execution timing of an image rewriting operation and a contour elimination operation.

FIG. 23 is a time chart showing the execution timing of an image rewriting operation and a contour elimination operation.

As shown in FIG. 23, the application of the contour elimination voltage described above is performed in parallel with image rewriting. More specifically, since the image writing state of the contour display pixel can be determined in units of a pixel by the writing state determining section 202, contour images can be eliminated sequentially from a pixel on which image rewriting is not performed (that is, a pixel to which the electric potential for changing the gray level is not supplied). Accordingly, since the display unit 3 is driven on the whole as if the image rewriting operation and the contour elimination operation were going on simultaneously in each pixel, it is possible to realize a state where it is very difficult to see a contour afterimage.

Figure 24:
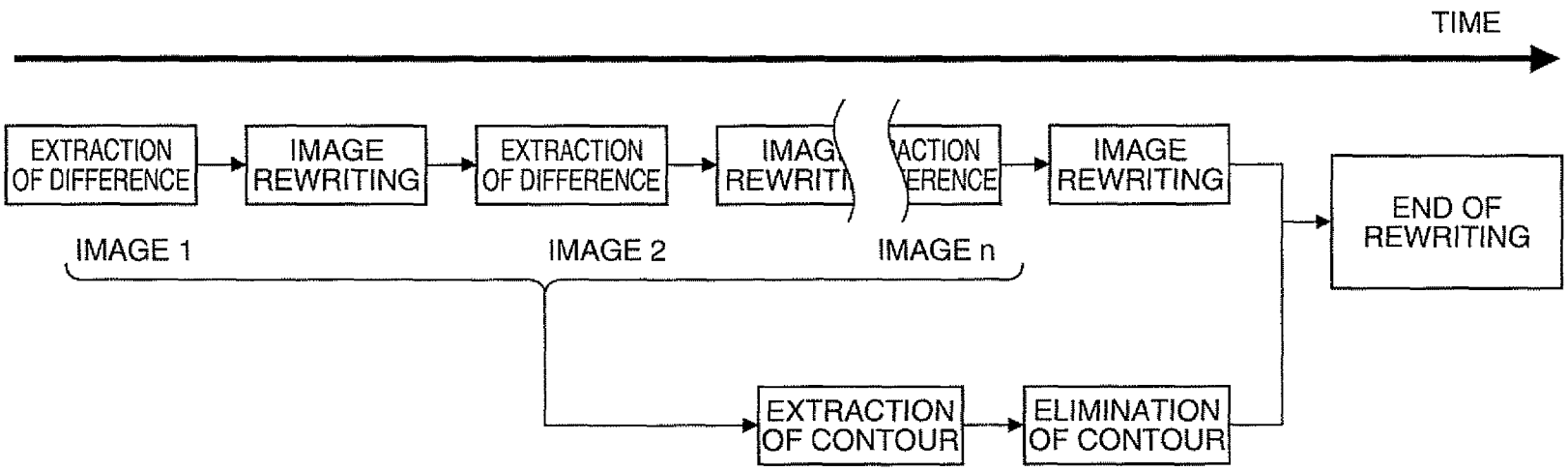
FIG. 24 is a time chart showing the execution timing of an image rewriting operation and a contour elimination operation.

FIG. 24 is a time chart showing the execution timing of an image rewriting operation and a contour elimination operation.

As shown in FIG. 24, the contour elimination voltage may be applied whenever image rewriting is performed multiple times instead of being applied every image rewriting. In this case, contour afterimages generated in image rewriting performed multiple times are eliminated collectively. In addition, the number of times of image rewriting required for performing the contour elimination process (that is, the value of n in FIG. 24) is set in advance on the basis of the contour afterimage elimination effect and the like. In addition, this number of times may be variable.

In the case of eliminating contour afterimages collectively, the contour afterimages are extracted as contour images generated in image rewriting performed multiple times, in the contour afterimage extraction in step S101. For example, if the OR operation of contour images generated in image rewriting performed multiple times is performed, the contour images generated in the image rewriting performed multiple times can be easily extracted.

If contour afterimages are collectively eliminated, the number of times by which the contour elimination voltage is applied is reduced. In proportion to the reduced value, the process can be made simple. As a result, it is possible to realize image display at higher speed.

As described above, in the electrophoretic display device according to the first embodiment, it is possible to suppress effectively the generation of a contour afterimage in an image displayed on the display unit 3. As a result, it becomes possible to display a high-quality image.

Second Embodiment

Next, an electrophoretic display device according to a second embodiment will be described with reference to FIGS. 25 to 35. In addition, the second embodiment is the same as the first embodiment except that some of the configuration and control are differ. For this reason, different sections from those in the first embodiment will be described in detail below, and explanation regarding the same sections will be appropriately omitted.

First, the configuration of a controller 10 according to the second embodiment will be described with reference to FIG. 25.

Figure 25:
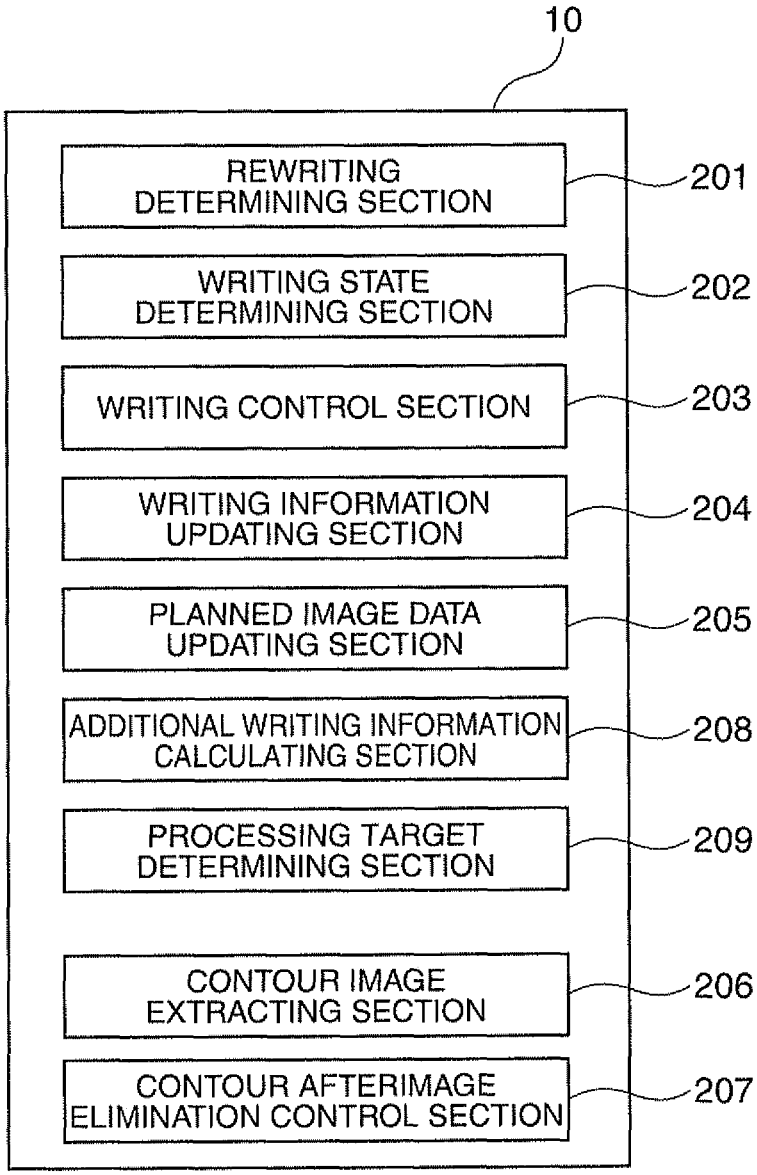
FIG. 25 is a block diagram showing the detailed configuration of a controller according to a second embodiment.

FIG. 25 is a block diagram showing the detailed configuration of the controller according to the second embodiment.

Referring to FIG. 25, the controller 10 according to the second embodiment is configured to include an additional writing information calculating section 208 and a processing target determining section 209 in addition to respective sections included in the controller 10 (refer to FIG. 5) according to the first embodiment described above.

When it is determined that the planned image data storage region 7 is to be updated in rewriting determination of the rewriting determining section 201, the additional writing information calculating section 208 calculates a difference between the pixel data of a display image stored in the VRAM 4 and the pixel data of a planned image stored in the planned image data storage region 7 and stores the image data based on the calculated difference in an additional writing information storage region 8 (refer to FIG. 27 and the like) which will be described later.

The processing target determining section 209 determines which storage region of a plurality of writing information storage regions 6 (refer to FIG. 27 and the like), which will be described later, should be referred to when each driving voltage is applied.

Next, the writing information storage region 6 will be described in detail.

Figure 27:
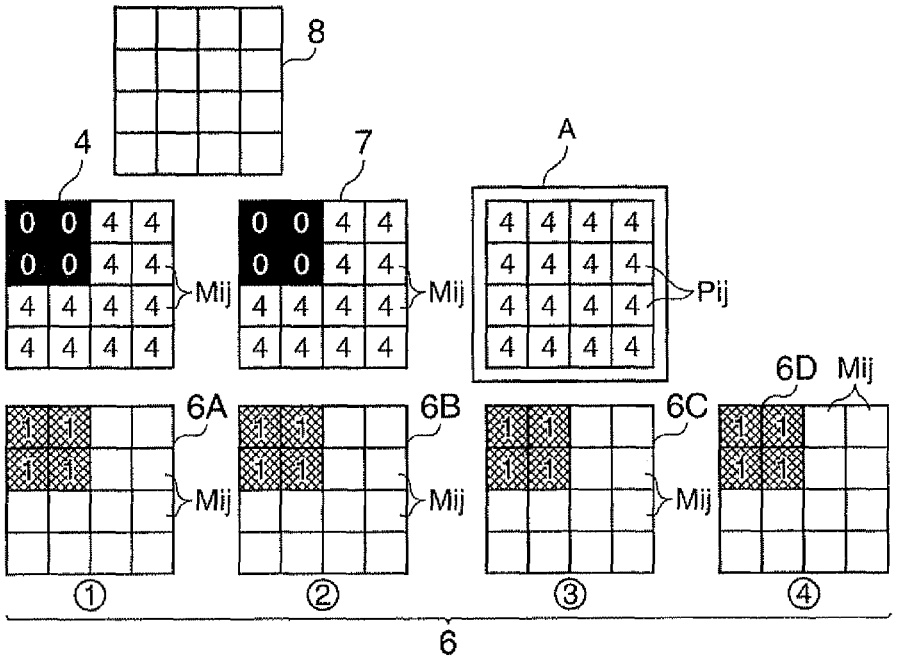
FIG. 27 is a conceptual diagram showing a method for applying a voltage to each pixel of the electrophoretic display device according to the second embodiment.

As can be understood from FIG. 27 and the like, four writing information storage regions 6 are prepared in the second embodiment, unlike the first embodiment. This number is equivalent to the number of times of application of a driving voltage for changing the display state of the pixel 20 from black to white or from white to black. That is, although the driving voltage is applied 7 times in order to change the display state of the pixel 20 from black to white or from white to black in the first embodiment, the driving voltage may also be applied 4 times in the second embodiment.

Flag information for identifying whether or not each pixel 20 is an object to which a driving voltage is to be applied is stored in each of the four writing information storage regions 6. For example, the flag information is ON when each pixel 20 is an object to which a driving voltage is to be applied, and the flag information is OFF when each pixel 20 is not an object to which a driving voltage is to be applied. In addition, information indicating whether the driving voltage is a driving voltage for changing the display state of each pixel 20 from black to white or a driving voltage for changing the display state of each pixel 20 from white to black is stored in the writing information storage region 6 so as to match the flag information.

In addition, the case where the one pixel 20 is an object to which a driving voltage is to be applied means that a writing operation on the pixel 20 is in progress, and the case where the one pixel 20 is not an object to which a driving voltage is to be applied means that a writing operation on the pixel 20 is not in progress. Accordingly, the writing information indicating whether or not a writing operation for changing the display state of each pixel is in progress is stored in the writing information storage region 6.

Hereinafter, the flag information for identifying whether or not the pixel 20 is an object to which a driving voltage is to be applied and the information indicating that the application of the driving voltage is for changing the display state of the pixel 20 from black to white are called first writing information together. In addition, the flag information for identifying whether or not the pixel 20 is an object to which a driving voltage is to be applied and the information indicating that the application of the driving voltage is for changing the display state of the pixel 20 from white to black are called second writing information together. In addition, the first writing information and the second writing information are collectively called writing information. In addition, the writing information storage region 6 according to the second embodiment is an example of a "flag storage section" according to the invention.

The reason why the same number of writing information storage regions 6 as the number of times of application of the driving voltage for changing the display state of the pixel 20 is as follows.

The writing operation for changing the display state of the pixel 20 from white to black, for example, includes an operation of supplying a data signal for displaying black on the pixel 20 four times (that is, an operation of applying a driving voltage to the pixel 20 four times). That is, the writing operation for changing the display state of the pixel 20 from white to black includes four frame periods. The writing information storage region 6 is prepared corresponding to each of the four frame periods.

The writing control section 203 refers to each writing information storage region 6 in order whenever a data signal is supplied (that is, whenever a driving voltage is applied to the pixel 20), and supplies the data signal to each pixel 20 on the basis of the content stored in the referred writing information storage region 6. Specifically, when the flag information of a certain pixel 20 in the writing information storage region 6 to be referred to in the first frame period, among the four writing information storage regions 6, is ON and the display state of the pixel 20 is changed from white to black, the writing control section 203 supplies a data signal for displaying black to the pixel. In addition, when the flag information of the certain pixel 20 in the writing information storage region 6 to be referred to in the next frame period is ON and the display state of the pixel 20 is changed from white to black, the writing control section 204 supplies a data signal for displaying black to the pixel again. When referring to the four writing information storage regions 6 corresponding to the four frame periods as described above ends, the object to be referred to becomes the first writing information storage region 6 again. Thus, one writing information storage region 6 corresponds to one frame period described above.

Next, an operation when rewriting an image in the electrophoretic display device according to the second embodiment will be described with reference to FIG. 26. For convenience of explanation, an operation for eliminating a contour afterimage will be omitted, and only an operation for rewriting an image will be described in detail.

Figure 26:
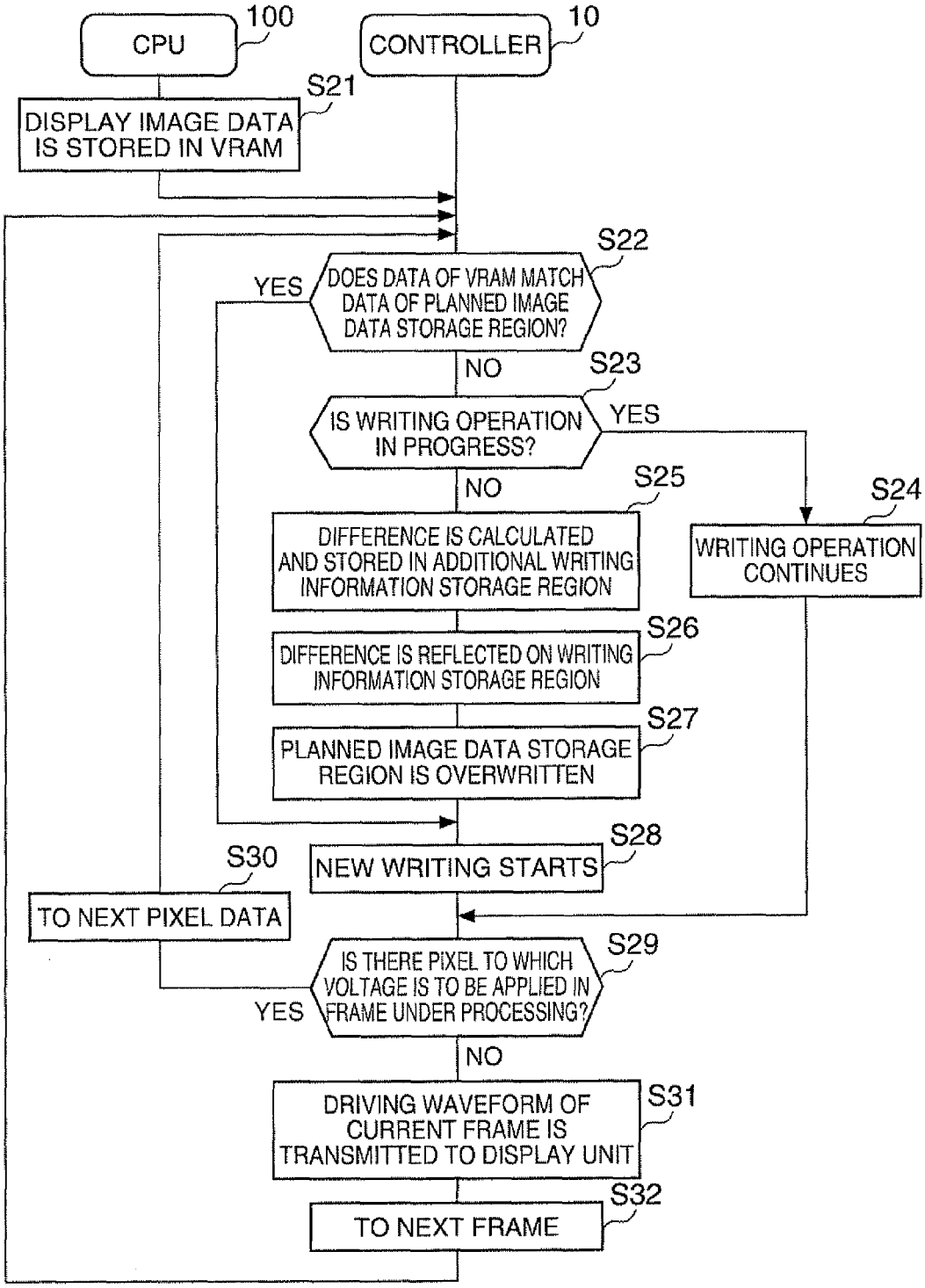
FIG. 26 is a flow chart showing an operation at the time of writing of the controller according to the second embodiment.

FIG. 26 is a flow chart showing an operation at the time of writing of the controller according to the second embodiment.

Referring to FIG. 26, when the operation of the electrophoretic display device according to the second embodiment starts, the CPU 100 stores the display image data displayed on the display unit 3 in the VRAM 4 first (step S21).

Then, the rewriting determining section 201 of the controller 10 determines, for one pixel 20, whether or not the pixel data of the display image stored in the VRAM 4 matches the pixel data of the planned image stored in the planned image data storage region 7 (step S22).

When the pixel data of the display image stored in the VRAM 4 matches the pixel data of the planned image stored in the planned image data storage region 7 (step S22: YES), the writing control section 203 starts a writing operation on the basis of the written content stored in the writing information storage region 6 (step S28). On the other hand, when the pixel data of the display image stored in the VRAM 4 is different from the pixel data of the planned image stored in the planned image data storage region 7 (step S22: NO), the writing state determining section 202 determines whether or not a writing operation in the corresponding pixel data is in progress with reference to the first and second writing information items stored in the writing information storage region 6 which is an object to be referred to (step S23).

If the writing operation is in progress (step S23: YES), the writing control section 203 continues the writing operation in progress (step S24), and the process proceeds to step S29. On the other hand, if the writing operation in the corresponding pixel data is not in progress (step S2: NO), the additional writing information calculating section 208 calculates a difference between the pixel data of the display image stored in the VRAM 4 and the pixel data of the planned image stored in the planned image data storage region 7 and stores the pixel data based on the difference in the additional writing information storage region 8 (step S25).

Then, the writing control section 203 registers the writing information regarding the target pixel 20 in the writing information storage region 6 on the basis of the pixel data stored in the additional writing information storage region 8 (step S26).

Then, the planned image data updating section 205 updates the planned image data, which is stored in the planned image data storage region 7, to the pixel data of a planned image when the writing control section 203 completes the writing according to the written content stored in the writing information storage region 6 (step S27).

Then, the writing control section 203 starts a writing operation on the basis of the written content stored in the writing information storage region 6 (step 328), and the process proceeds to step S29.

The processing target determining section 209 determines whether or not the pixel 20, which is an object to which a driving voltage is to be applied, is further present in the writing information storage region 6 to be referred to at this point in time (step S29). When the pixel 20, which is an object to which a driving voltage is to be applied, is further present (step S29: YES), the processing target determining section 209 moves a pixel, which is to be processed in the same writing information storage region 6, to the next pixel (step S30). Then, the process returns to step S2. On the other hand, when the pixel 20, which is an object to which a driving voltage is to be applied, is not present further (step S29: NO), the processing target determining section 209 transmits to the display unit 3 an image signal and the like according to the current writing information storage region 6 (step S31), and movement to the next writing information storage region 6 from the writing information storage region 6 to be referred to is made (step S32).

Next, an image rewriting operation of the electrophoretic display device according to the second embodiment will be described more specifically with reference to FIGS. 27 to 35.

FIGS. 27 to 35 are conceptual views showing a method of voltage application to each pixel of the electrophoretic display device according to the second embodiment. Moreover, in FIGS. 27 to 35, some pixels in the display unit 3 are shown as Pij (where i represents a row number and j represents a column number). In each pixel Pij, the gray level is expressed in five steps of "0" corresponding to black to "4" corresponding to white.

As described above, four frames are used for the gray level change from white to black or from black to white in the present embodiment. Therefore, the writing information storage region 6 includes total four writing information storage regions 6A to 6D corresponding to each frame. In addition, numbers (1), (2), (3), and (4) given to the writing information storage regions GA to 6D represent the order number that is referenced.

A storage region Mij corresponding to the pixel Pij of the display unit 3 is provided in each of the VRAM 4 and the planned image data storage region 7. The pixel data (that is, gray level) of the display image is stored in the storage region Mij of the VRAM 4, and the pixel data (that is, gray level) of the planned image is stored in the storage region Mij of the planned image data storage region 7.

The storage region Mij where the writing information corresponding to the pixel Pij of the display unit 3 is stored is provided in each of the writing information storage regions 6A to 6D.

For a pixel whose display state is to be changed, the controller 10 stores "1" as the writing information in the storage region Mij in order of the writing information storage region 6A, the writing information storage region 6B, the writing information storage region 6C, and the writing information storage region 6D on the basis of the image data stored in the VRAM 4. After the writing to the pixel Pij of the display unit 3 is performed on the basis of the writing information stored in the writing information storage region 6D, the writing information storage region 6A becomes a recording area of the writing information by return to the head. In addition, "1" shown in the drawing is the flag information "ON" meaning an object to which a driving voltage is to be applied.

Referring to FIG. 27, "1" is stored in the storage regions M11, M12, M21, and M22 of the writing information storage regions 6A to 6D since the pixels P11, P12, P21, and P22 are rewritten from white to black. In this case, since the pixels P11, P12, P21, and P22 are rewritten from white to black, the writing information stored in the storage regions M11, M12, M21, and M22 is equivalent to the second writing information.

Figure 28:
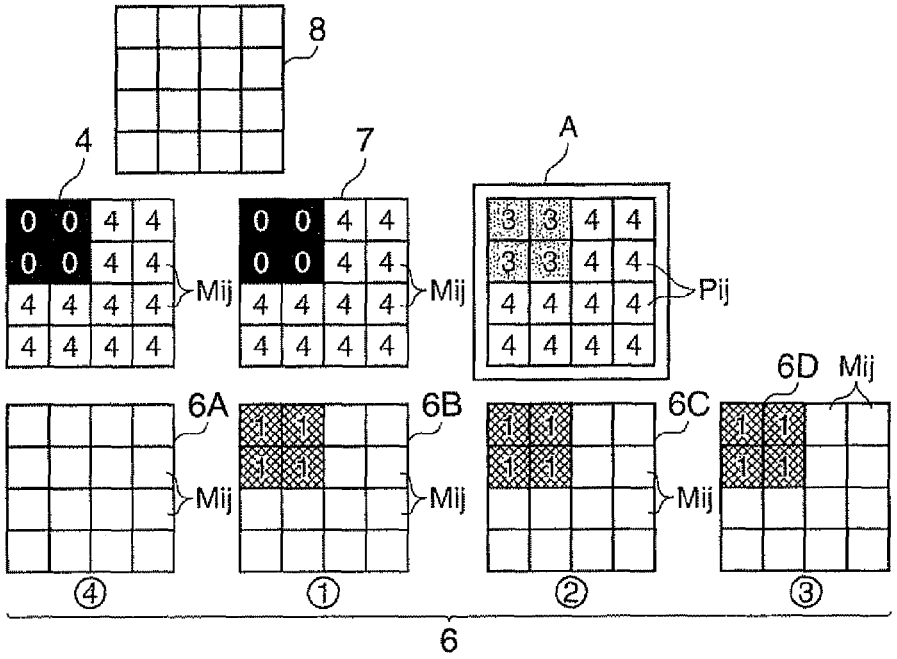
FIG. 28 is a conceptual diagram showing a method for applying a voltage to each pixel of the electrophoretic display device according to the second embodiment.

FIG. 28 shows a state when a writing operation of one frame has ended from the state shown in FIG. 27. In FIG. 28, the written content of the writing information storage region 6A in FIG. 7 is reflected on the pixels P11, P12, P21, and P22.

Figure 29:
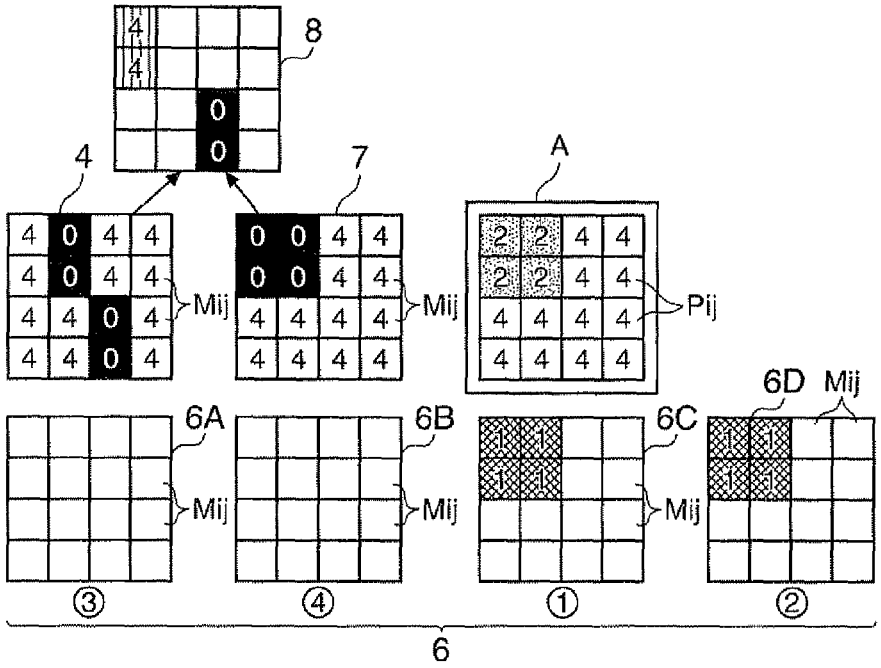
FIG. 29 is a conceptual diagram showing a method for applying a voltage to each pixel of the electrophoretic display device according to the second embodiment.

FIG. 29 shows a state when a writing operation of two frames has ended from the state shown in FIG. 27. In FIG. 28, the written content of the writing information storage region 6B in FIG. 28 is reflected on the pixels P11, P12, P21, and P22. At this timing, a case will be considered below in which a difference between the image data stored in the VRAM 4 and the image data stored in the planned image data storage region 7 is caused by the CPU 100.

In FIG. 29, the rewriting determining section 201 compares the pixel data stored in each storage region Mij of the VRAM 4 with the pixel data stored in each storage region Mij of the planned image data storage region 7, for each pixel Pij. As a result, the rewriting determining section 201 determines that the pixel data stored in each storage region Mij of the VRAM 4 and the pixel data stored in each storage region Mij of the planned image data storage region 7 are different for the storage regions M11, M12, M33, and M43, and determines that they are the same for the other storage regions.

Then, the writing state determining section 202 refers to the writing information in each storage region Mij, which is stored in the writing information storage regions 6A to 6D, for each pixel Pij. As a result, the writing state determining section 202 determines that the writing operation is in progress for the pixels P11, P12, P21, and P22 and the writing operation is not in progress for the other pixels. Accordingly, the writing operation is continued for the pixels P11, P12, P21, and P22 on which the writing operation is in progress.

Then, the additional writing information calculating section 208 calculates a difference between the pixel data stored in each storage region Mij of the VRAM 4 and the pixel data stored in each storage region Mij of the planned image data storage region 7 on the basis of the comparison result of the rewriting determining section 201, and stores the pixel data based on the calculated difference in the additional writing information storage region 8.

The writing control section 203 updates the content of the writing information storage region 6 on the basis of the image data stored in the additional writing information storage region 8. Specifically, since the rewriting from white to black should be performed for the pixels P33 and P43, the writing control section 203 registers information indicating an object to which a driving voltage for change from white to black is to be applied, as the second writing information, in each of the storage regions M33 and M43 in the writing information storage regions 6A to 6D.

In addition, for the pixels P11 and P22, rewriting from black to white should be performed. However, since the writing state determining section 202 determines that a writing operation is in progress for the pixels P11 and P21, the storage regions M11 and M21 corresponding to the pixels P11 and P21 in the writing information storage region 6 are not updated at this point in time.

Then, the planned image data updating section 205 updates the storage region Mij of the planned image data storage region 7 to the pixel data when the writing control section 203 completes the writing according to the written content stored in the writing information storage region 6. As a result of such writing control, the writing information storage regions 6A to 6D and the planned image data storage region 7 are in the state shown in FIG. 30.

Figure 30:
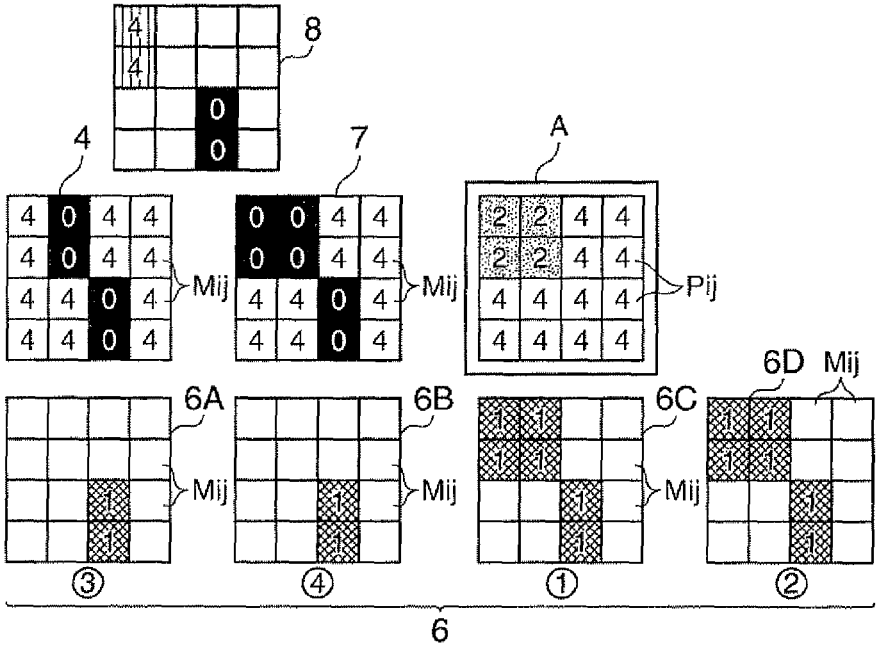
FIG. 30 is a conceptual diagram showing a method for applying a voltage to each pixel of the electrophoretic display device according to the second embodiment.

Referring to FIG. 30, according to the information of the writing information storage region 6C after updating, the writing control section 203 continues the writing operation in progress for the pixels P11, P12, P21, and P22 and starts a new writing operation for the pixels P33 and P43. Thus, when the image data stored in the VRAM 4 is rewritten from the state shown in FIG. 28 to the state shown in FIGS. 29 and 30, writing based on the image data of the VRAM 4 in FIGS. 29 and 30 can be started in some pixels (that is, P33 and P43) even if the writing operation on the pixels P11, P12, P21, and P22 based on the image data of the VRAM 4 in FIG. 28 is in progress. As a result, it is possible to improve the perceived response speed.

Figure 31:
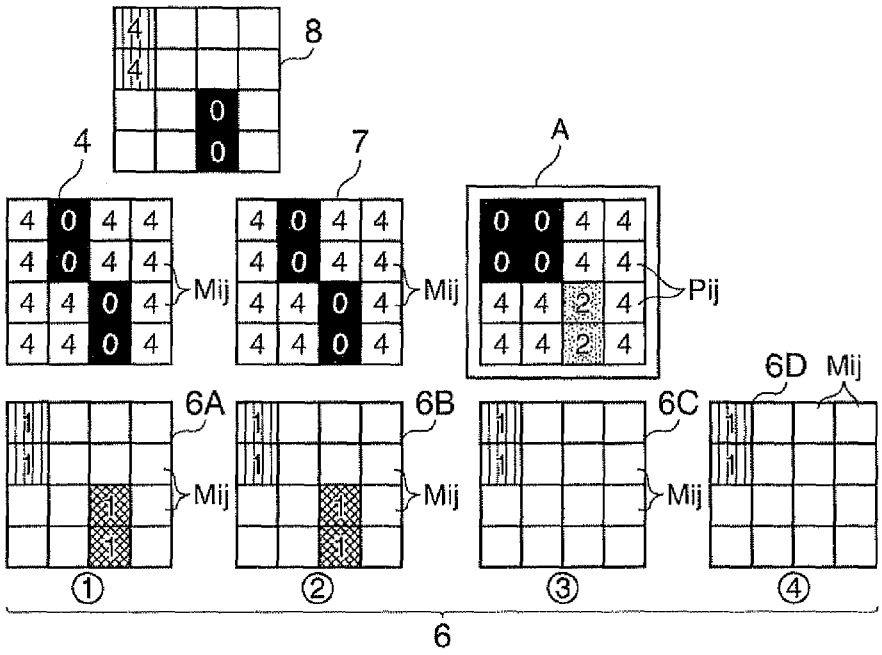
FIG. 31 is a conceptual diagram showing a method for applying a voltage to each pixel of the electrophoretic display device according to the second embodiment.

FIG. 31 shows a state when a writing operation of two frames has ended from the state shown in FIG. 30. As shown in FIG. 31, the writing operation from white to black has ended for the pixels P11, P12, P21, and P22, and the writing operation from white to black is in progress for the pixels P33 and P43. Moreover, in FIG. 31, the writing control section 203 has updated the writing information storage region 6 on the basis of the image data stored in the additional writing information storage region 8. Specifically, since the writing from black to white should be performed for the pixels P11 and P21, the writing control section 203 registers the first writing information in each of the storage regions M11 and M21 in the writing information storage regions 6A to 6D.

Figure 32:
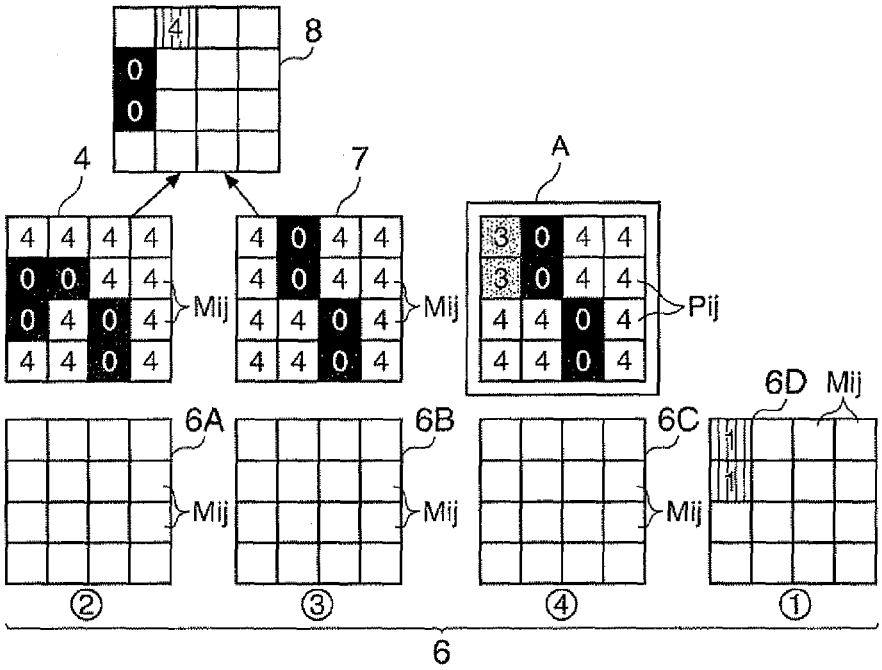
FIG. 32 is a conceptual diagram showing a method for applying a voltage to each pixel of the electrophoretic display device according to the second embodiment.

FIG. 32 shows a state when a writing operation of three frames has ended from the state shown in FIG. 31. As shown in FIG. 32, a writing operation on the pixels P33 and P43 has ended. At this timing, a case is considered in which the CPU 100 updates the VRAM 4 as shown in the drawing to cause a difference between the image data stored in the VRAM 4 and the image data stored in the planned image data storage region 7.

In FIG. 32, the writing state determining section 202 refers to the writing information in each storage region Mij, which is stored in the writing information storage regions 6A to 6D, for each pixel Pij. As a result, the writing state determining section 202 determines that the writing operation is in progress for the pixels P11 and P21 and the writing operation is not in progress for the other pixels. Accordingly, the writing operation is continued for the pixels P11 and P21 on which the writing operation is in progress.

Moreover, in FIG. 32, the rewriting determining section 201 compares the pixel data stored in each storage region Mij of the VRAM 4 with the pixel data stored in each storage region Mij of the planned image data storage region 7, for each pixel Pij. As a result, the rewriting determining section 201 determines that the pixel data stored in each storage region Mij of the VRAM 4 and the pixel data stored in each storage region Mij of the planned image data storage region 7 are different for the storage regions M12, M21, and M31, and determines that they are the same for the other storage regions.

Then, the writing state determining section 202 refers to the writing information in each storage region Mij, which is stored in the writing information storage regions 6A to 6D, for each pixel Pij. As a result, the writing state determining section 202 determines that the writing operation is in progress for the pixels P11 and P21 and the writing operation is not in progress for the other pixels.

Then, the additional writing information calculating section 208 calculates a difference between the pixel data stored in each storage region Mij of the VRAM 4 and the pixel data stored in each storage region Mij of the planned image data storage region 7 on the basis of the comparison result of the rewriting determining section 201, and stores the pixel data based on the calculated difference in the additional writing information storage region 8.

The writing control section 203 updates the content of the writing information storage region 6 on the basis of the image data stored in the additional writing information storage region 8. Specifically, since the rewriting from black to white should be performed for the pixel P12, the writing control section 203 registers the first writing information in the storage region M31 in the writing information storage regions 6A to 60.

In addition, for the pixel P21, rewriting from white to black should be performed. However, since the writing state determining section 202 determines that a writing operation on the pixels P21 is in progress, the storage regions M11 and M21 corresponding to the pixel P21 in the writing information storage region 6 are not updated at this point in time.

Then, the planned image data updating section 205 updates the storage region Mij of the planned image data storage region 7 to the pixel data when the writing control section 203 completes the writing according to the written content stored in the writing information storage region 6. As a result of such writing control, the writing information storage regions 6A to 6D and the planned image data storage region 7 are in the state shown in FIG. 33.

Figure 33:
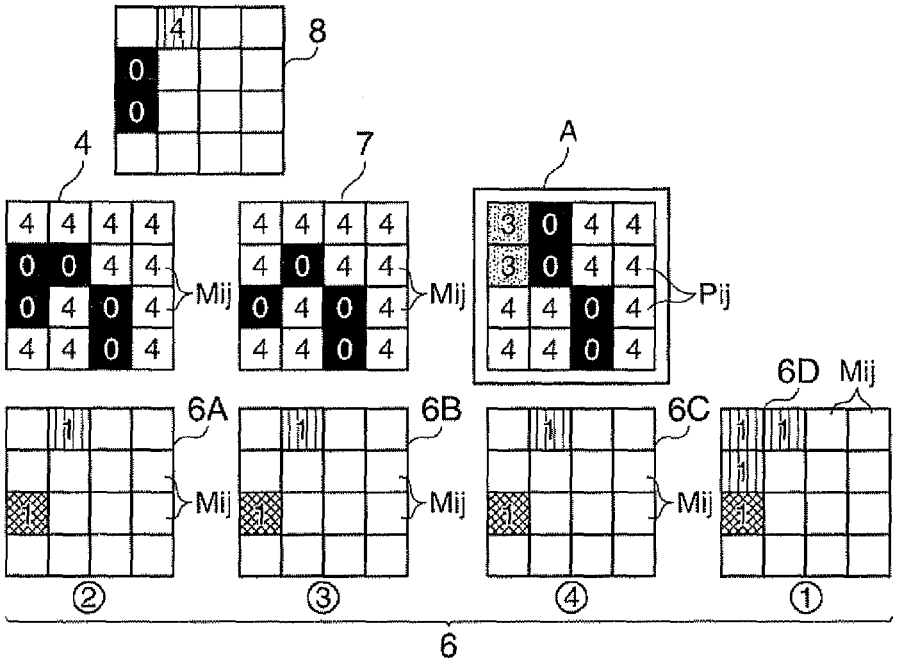
FIG. 33 is a conceptual diagram showing a method for applying a voltage to each pixel of the electrophoretic display device according to the second embodiment.

Referring to FIG. 33, according to the information of the writing information storage region 6D after updating, the writing control section 203 continues the writing operation in progress for the pixels P11 and P21 and starts a new writing operation for the pixels P12 and P31.

Figure 34:
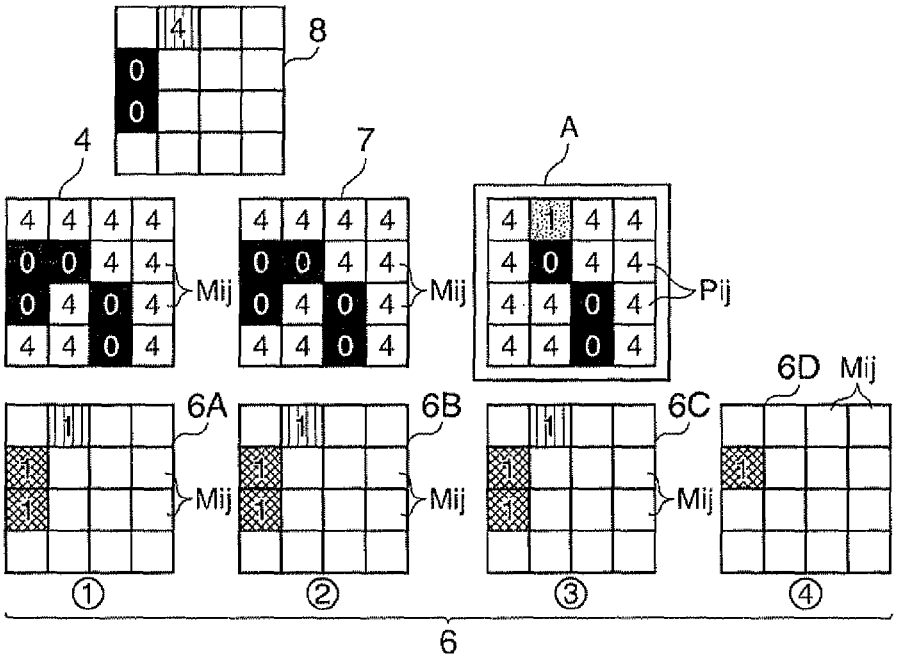
FIG. 34 is a conceptual diagram showing a method for applying a voltage to each pixel of the electrophoretic display device according to the second embodiment.

FIG. 34 shows a state when a writing operation of one frame has ended from the state shown in FIG. 33. As shown in FIG. 34, the writing operation from black to white has ended for the pixels P11 and P21, and the writing operation from black to white is in progress for the pixel P12. Moreover, in FIG. 34, the writing control section 203 has updated the writing information storage region 6 on the basis of the image data stored in the additional writing information storage region 8. Specifically, since the writing from white to black should be performed for the pixel P21, the writing control section 203 registers the second writing information in the storage region M21 in the writing information storage regions 6A to 6D.

Moreover, on the basis of the content of the updated writing information storage region 6, the planned image data updating section 205 updates the planned image data in the planned image data storage region 7 to the pixel data when the writing control section 203 completes the writing according to the written content stored in the writing information storage region 6.

Figure 35:
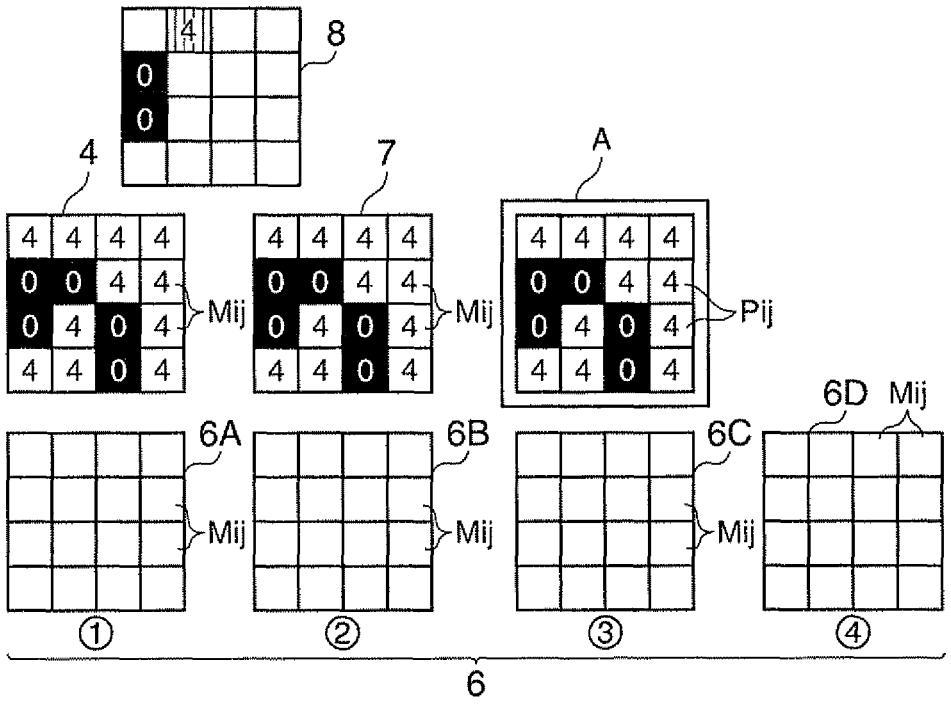
FIG. 35 is a conceptual diagram showing a method for applying a voltage to each pixel of the electrophoretic display device according to the second embodiment.

FIG. 35 shows a state when a writing operation of four frames has ended from the state shown in FIG. 34. As shown in FIG. 35, all writing operations have ended, and the image data in the display image A is the same as the image data stored in the VRAM 4.

As described above, according to the second embodiment, it is determined in units of a pixel whether or not a writing operation is in progress, and a new writing operation starts from the pixel 20 to which writing has ended when necessary. Therefore, in the electrophoretic display device which takes a relatively long time to rewrite an image, it is possible to improve the perceived response speed of image display. In particular, in the present embodiment, it is possible to determine in units of a pixel whether or not a writing operation is in progress, as described above. Accordingly, the same contour afterimage elimination operation as in the first embodiment can be performed. That is, also in the second embodiment, the contour afterimage elimination operation described with reference to FIGS. 16 to 24 can be performed.

Here, the second embodiment is different from the first embodiment in the configuration of a storage region used for rewriting of an image and the control method using the configuration. However, also in the second embodiment, a contour elimination voltage can be applied in the same method as in the first embodiment since it is possible to determine in units of a pixel whether or not a writing operation is in progress as in the first embodiment. Specifically, it is preferable to register the first writing information or the second writing information in the writing information storage regions 6A to 6D corresponding to the frame period for which the contour elimination voltage is to be applied.

As described above, in the electrophoretic display device according to the second embodiment, it is possible to suppress effectively the generation of a contour afterimage in an image displayed on the display unit 3 in the same manner as in the first embodiment. As a result, it becomes possible to display a high-quality image.

Electronic Apparatus

Next, an electronic apparatus to which the above electrophoretic display device is applied will be described with reference to FIGS. 36 and 37. Cases where the electrophoretic display device described above is applied to electronic paper and an electronic book will be exemplified below.

Figure 36:
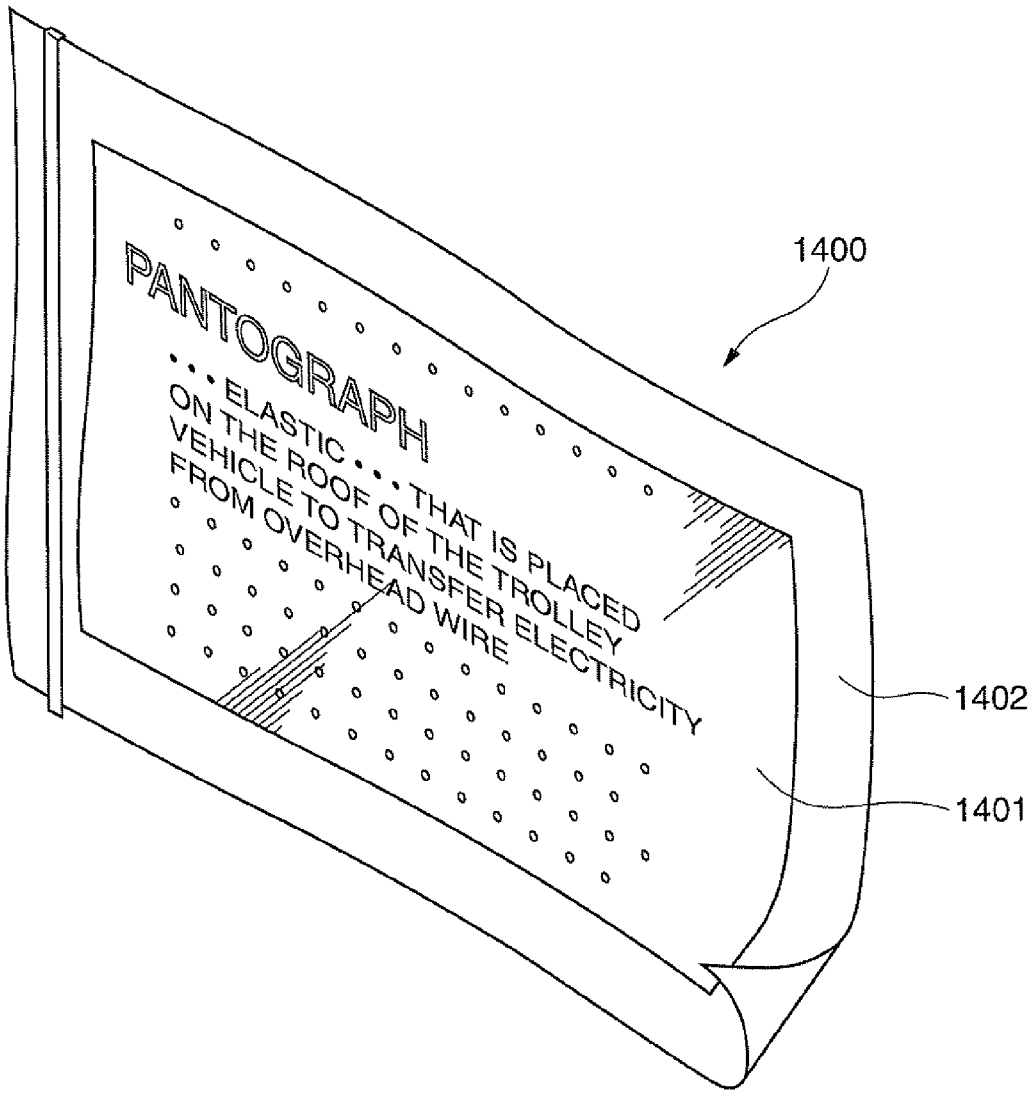
FIG. 36 is a perspective view showing the configuration of electronic paper which is an example of an electronic apparatus to which the electro-optical device is applied.

FIG. 36 is a perspective view showing the configuration of electronic paper 1400.

As shown in FIG. 36, the electronic paper 1400 includes the electrophoretic display device according to the embodiment described above as a display unit 1401. The electronic paper 1400 is flexible, and includes a main body 1402 formed by a rewritable sheet having the same texture and flexibility as paper in the related art.

Figure 37:
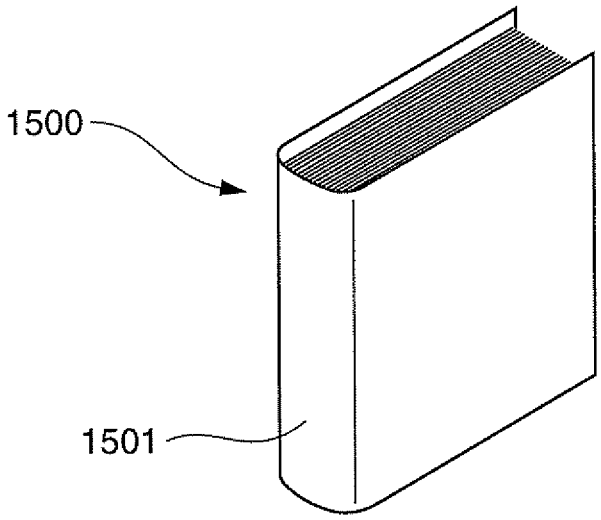
FIG. 37 is a perspective view showing the configuration of electronic book which is an example of an electronic apparatus to which the electro-optical device is applied.

FIG. 37 is a perspective view showing the configuration of an electronic book 1500.

As shown in FIG. 37, in the electronic book 1500, a plurality of sheets of the electronic paper 1400 shown in FIG. 36 are bundled and inserted in a cover 1501. The cover 1501 includes a display data input section (not shown) for inputting the display data transmitted from an external apparatus, for example. In this case, the contents of display can be changed or updated according to the display data in a state where the electronic paper is bundled.

Since the electronic paper 1400 and the electronic book 1500 described above include the electrophoretic display device according to the embodiment described above, it is possible to display a high-quality image.

In addition to these, the electrophoretic display device according to the present embodiment described above may be applied to display units of electronic apparatuses, such as wrist watches, mobile phones, and portable audio equipment.

In addition, although the example where the white particles 82 are negatively charged and the black particles 83 are positively charged has been described in the above embodiments, the white particles 82 may be positively charged and the black particles 83 may be negatively charged. In addition, the electrophoretic element 23 may have a configuration in which an electrophoretic dispersion medium and electrophoretic particles are included in a space divided by a partition wall, without being limited to the configuration including the microcapsules 80. In addition, although the example where the electrophoretic element 23 is provided as an electro-optical device has been described, the invention is not limited to this. Any kind of electro-optical device may be used as long as it is an electro-optical device including a display device on which a contour afterimage may be generated as in the embodiments described above. For example, an electro-optical device using the electronic liquid powder may be used.

The invention is not limited to the above-described embodiments, and may be appropriately modified without departing from the subject matter and spirit of the invention read throughout the appended claims and specification. A control method of an electro-optical device, a controller of an electro-optical device, an electro-optical device, and an electronic apparatus according to such modifications also fall within the technical scope of the invention.

The entire disclosure of Japanese Patent Application No: 2011-214383, filed Sep. 29, 2011, and U.S. Provisional Application No. 61/484372, filed May 10, 2011 are expressly incorporated by reference herein.

What is claimed is:

1. A control method of an electro-optical device including a display unit having a plurality of pixels, which are provided corresponding to intersections of a plurality of scanning lines and a plurality of data lines crossing each other and each of which has an electro-optical material interposed between a pixel electrode and a counter electrode facing each other, and a driving unit that performs electric potential supply, which is for supplying a data potential according to image data to the pixel electrode of each of the plurality of pixels in a predetermined frame period, multiple times in order to display an image corresponding to the image data on the display unit, the control method comprising:

performing a first supply process for supplying an electric potential corresponding to a changed gray level to the pixel electrode of a first pixel whose gray level to be displayed changes at the time of image rewriting in which an image displayed on the display unit is rewritten;

performing a second supply process for supplying the same electric potential as an electric potential of the counter electrode to the pixel electrode of a second pixel whose gray level to be displayed does not change at the time of the image rewriting;

extracting a contour image from a difference between an image before the image rewriting and an image after the image rewriting;

determining whether or not the first supply process is being performed, in units of a pixel, for contour display pixels that display the contour image; and performing a contour elimination process for supplying an electric potential for eliminating the contour image to the pixel electrode of a pixel, for which it is determined that the first supply process is not being performed, among the contour display pixels.

2. The control method of an electro-optical device according to claim 1, wherein in the contour elimination process, an electric potential for eliminating the contour image is supplied to the pixel electrode of a pixel for which it is determined that the first supply process is not being performed, among the contour display pixels, in a last frame period of the first supply process performed for pixels adjacent to each other.

3. The control method of an electro-optical device according to claim 1, wherein in the contour elimination process, an electric potential for eliminating the contour image is supplied to the pixel electrode of a pixel for which it is determined that the first supply process is being performed, among the contour display pixels, in a frame period after the first supply process ends.

4. The control method of an electro-optical device according to claim 1, wherein the contour elimination process is performed once for the image rewriting performed multiple times.

5. The control method of an electro-optical device according to claim 1, wherein a period for which the electric potential for eliminating the contour image is supplied in the contour elimination process is shorter than a period for which the electric potential corresponding to the changed gray level is supplied in the first supply process.

6. A controller of an electro-optical device including a display unit having a plurality of pixels, which are provided corresponding to intersections of a plurality of scanning lines and a plurality of data lines crossing each other and each of which has an electro-optical material interposed between a pixel electrode and a counter electrode facing each other, and a driving unit that performs electric potential supply, which is for supplying a data potential according to image data to the pixel electrode of each of the plurality of pixels in a predetermined frame period, multiple times in order to display an image corresponding to the image data on the display unit, the controller comprising:

a first supply section that supplies an electric potential corresponding to a changed gray level to the pixel electrode of a first pixel whose gray level to be displayed changes at the time of image rewriting in which an image displayed on the display unit is rewritten;

a second supply section that supplies the same electric potential as an electric potential of the counter electrode to the pixel electrode of a second pixel whose gray level to be displayed does not change at the time of the image rewriting;

an extraction section that extracts a contour image from a difference between an image before the image rewriting and an image after the image rewriting;

a determination section that determines whether or not the electric potential supply of the first supply section is being performed, in units of a pixel, for contour display pixels that display the contour image; and a contour elimination section that supplies an electric potential for eliminating the contour image to the pixel electrode of a pixel, for which it is determined that the electric potential supply of the first supply section is not being performed, among the contour display pixels.

7. An electro-optical device comprising the controller of an electro-optical device according to claim 6.

8. An electronic apparatus comprising the electro-optical device according to claim 7.

9. The control method of an electro-optical device according to claim 1, wherein the contour image is an image corresponding to a contour afterimage generated by partial image rewriting in the first supple process of the second supple process.

10. The controller of an electro-optical device according to claim 6, wherein the contour image is an image corresponding to a contour afterimage generated by partial image rewriting in the first supply section or the second supple section.

11. The controller of an electro-optical device according to claim 6, further comprising:

a plurality of flag storage sections that store flag information, which indicates whether to perform the electric potential supply of the first supply section for each of the plurality of pixels, in units of a frame period.

12. The control method of an electro-optical device according to claim 1, wherein the difference is extracted before the image rewriting.

13. The controller of an electro-optical device according to claim 6, further comprising:

a number-of-times storage section that stores the number of times by which the electric potential supply of the first supply section for each of the plurality of pixels is performed; and a decrement section that decrements the number of times by which the electric potential supply is performed, which is stored in the number-of-times storage section, whenever the electric potential supply is performed.

14. The controller of an electro-optical device according to claim 6, wherein the extraction section extracts the difference before the image writing.

* * * * *